US006422275B1

(12) United States Patent
Smith et al.

(10) Patent No.: US 6,422,275 B1
(45) **Date of Patent: *Jul. 23, 2002**

(54) PLATE JOINER

(75) Inventors: John C. Smith; Earl R. Clowers, both of Jackson, TN (US)

(73) Assignee: Porter-Cable Coporation, Jackson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/276,393

(22) Filed: Mar. 25, 1999

Related U.S. Application Data

(63) Continuation of application No. 08/872,015, filed on Jun. 9, 1997.

(51) Int. Cl.[7] ..... B27C 5/10

(52) U.S. Cl. ..... 144/136.95; 144/154.5; 144/371; 409/182

(58) Field of Search ..... 30/374, 375, 376, 30/377; 409/182; 144/134.1, 136.95, 137, 154.5, 371

(56) References Cited

U.S. PATENT DOCUMENTS

| | | | |
|---|---|---|---|
| 1,687,207 | A | 10/1928 | Hawker |
| 1,981,183 | A | 11/1934 | Margellis |
| 2,378,713 | A | 6/1945 | Lawton |
| 2,610,658 | A | 9/1952 | Koeling |
| D194,736 | S | 2/1963 | Godfrey |
| D201,755 | S | 7/1965 | Johnson |
| 3,282,308 | A | 11/1966 | Sprague |
| D214,987 | S | 8/1969 | Ballone et al. |
| 3,812,584 | A | 5/1974 | Peter |
| 4,434,586 | A | 3/1984 | Müller et al. |
| 4,545,121 | A | 10/1985 | Armbruster et al. |
| 4,615,654 | A | 10/1986 | Shaw |
| 4,858,661 | A | 8/1989 | Bosten et al. |

(List continued on next page.)

FOREIGN PATENT DOCUMENTS

| | | |
|---|---|---|
| CH | 337653 | 5/1959 |
| CH | 339735 | 8/1959 |
| DE | 28 38 233 | 6/1979 |
| WO | WO 80/00993 | 5/1980 |

OTHER PUBLICATIONS

"Mr. Smith's Plot Chart For Pivot Point Locations Measured on Eighteen Porter—Cable 557 Plate Joiners", 1 page (Date Unknown).
"557 Pivot Point Locations as measured by Mr. Szoboscan", 1 page (Date Unknown).
"557 Pivot Point Locations as measured by Mr. John Smith", 1 page (Date Unknown).

(List continued on next page.)

*Primary Examiner*—W. Donald Bray
(74) *Attorney, Agent, or Firm*—Merchant & Gould P.C.

(57) ABSTRACT

A plate joiner including a fence support, a drive, and a fence system. The fence support includes a cutter and a contact surface, which defines a cutter slot. The cutter is arranged and configured to protrude from fence support through cutter slot to make a plunge cut into a surface of a workpiece when the contact surface is pressed against the surface and the cutter is plunged into the workpiece by pushing on a rearward handle portion of the tool. The drive is arranged and configured to rotatably drive the cutter through a motor.

A preferred fence system includes an angle adjustment system arranged and configured to position the fence at a wide range of fence angles and, at any selected distance from a top face of the workpiece to the fence, the distance from the top face of the workpiece to the cutter remains constant as the front fence angle is adjusted. A preferred fence system includes a trunnion which pivotally couples the front fence to the fence system. A preferred fence system also includes an angle segment member, which has two slots used to position the fence in two ranges of fence angles.

82 Claims, 28 Drawing Sheets

U.S. PATENT DOCUMENTS

| | | | | |
|---|---|---|---|---|
| 4,858,662 | A | 8/1989 | Bosten et al. | |
| 4,858,663 | A | 8/1989 | Bosten et al. | |
| 4,913,204 | A | 4/1990 | Moores et al. | |
| 4,934,422 | A | 6/1990 | Hempy et al. | |
| 4,947,908 | A | 8/1990 | O'Banion et al. | |
| 4,971,122 | A | 11/1990 | Sato et al. | |
| D315,281 | S | 3/1991 | Bosten et al. | |
| D326,103 | S | 5/1992 | Hempy et al. | |
| 5,257,654 | A | 11/1993 | Bean et al. | |
| 5,273,091 | A | 12/1993 | Shibata | |
| 5,289,861 | A | 3/1994 | Hedrick | |
| 5,291,928 | A | 3/1994 | Keith, Jr. et al. | |
| 5,381,595 | A | 1/1995 | Keith, Jr. et al. | |
| 5,865,230 | A * | 2/1999 | Smith et al. | 144/136.95 |

OTHER PUBLICATIONS

"Pivot Point Location", 1 page (Date Unknown).
"Rule 26(a)(2)(B) Expert Wintness Report of J. Szoboscan", 32 pages (Sep. 25, 1998).
"Trial Testimony of Matthew G. Popik", 15 pages (Jan.–Feb. 1999).
"Trial Testimony of Henry W. Stoll", 15 pages (Jan.–Feb. 1999).
"Trial Testimony of John C. Smith", 24 pages (Jan.–Feb. 1999).
"Trial Testimony of Attorney Scott", 3 pages (Jan.–Feb. 1999).
"Trial Testimony of Leslie J. Banduch", 10 pages (Jan.–Feb. 1999).
"Trial Testimony of John P. Sumner", 24 pages (Jan.–Feb. 1999).
"Trial Testimony of Michael Gilliland", 15 pages (Jan.–Feb. 1999).
"Trial Testimony of Mark T. Skoog", 12 pages (Jan.–Feb. 1999).
"Trial Testimony, Closing Argument by the Defendant", 3 pages (Jan.–Feb. 1999).
"Trial Testimony, Rebuttal Argument by the Plaintiff", 3 pages (Jan.–Feb. 1999).
Black & Decker, Inc. v. Porter–Cable Corporation, Case No. 98–436–A, Trial Transcripts, Week 1 (Jan.–Feb. 1999).
Black & Decker, Inc. v. Porter–Cable Corporation, Case No. 98–436–A, Trial Transcripts, Week 2 (Jan.–Feb. 1999).
Foster, "Wat's New In Biscuit Joiners", *Popular Woodworking,* (pp. 48–52), Nov., 1995.
Okrend, "The Workbench Guide to Plate Joiners", *Workbench, the Do–It–Yourself Magazine,* (pp. 19–28), Mar.–Apr., 1988.
"Rodale's American Woodworker", 190 34, ( 6 pgs.), Oct. 1993.
"Tool Review, Plate Joiners", *ShopNotes*™, Issue 3, (pp. 20–21).
"Feature Project, Plate Joiner Table", *ShopNotes*® Issue 33, vol. 6, (pp.16–25).
"Selecting Tools, Plate Joiners", *ShopNotes*® Issue 33, vol. 6, (pp. 26–29).
Lauziere, "Survey of Biscuit Joiners", *Fine Homebuilding,* (pp.46–51), Feb./Mar. 1995.
Robinson, "Picking a Plate Joiner", *Fine Woodworking,* (pp. 52–57), Jan./Feb. 1995.
"Woodhaven Uncommon Woodworking Tools", Catalog (cover pg. and pp. 57–59), Aug. 1993.
Makita brochure, "Heavy Duty Plater Joiner for Strong, Secuire Joints", (2 pgs.).
Makita brochure, "Precisely Better, Plate Joiner—Model 3901", (2 pgs.).
Practical Products Co., "Practical CA–800 Plate Joiner", (1 pg.).
Ryobi Detail Biscuit Joiner brochure (2 pgs.).
DeWalt® Instruction Manual, DW682 Plate Joiner, (18 pgs.), Copyright 1993.
Lamello *Top 10*, Operating Instructions (8 pgs.).
*freud*® Instruction and Safety Manual, "How to Use the Freud Joiner Machine", (12 pgs.).
Roybi® Owner's Operating Manual, Joiner Machine JM–100K, 16 pgs.).
Elu brochure, date unknown, entitled "Another First From Elu. 'Biscuit' Jointer and Groover. DS 140".
Lamello Top brochure, date unknown, entitled "Nutfräsmaschine mit schwenkbarem Anschlag Für Top–Verbindungen . . . damit die Arbeit Spass macht".
Lamello Top brochure, date unknown, entitled "Groove cutting machine with swivelling stop For top connections . . . that make work a pleasure" (English version of preceding reference).
P. 9 from Lamello brochure, date unknown.
Two photographs of Lamello Top.
Lamello Operating instructions, date unknown.
Lamello Junior brochure, date unknown, entitled "Groove Milling Machine for original Lamello joints".
Two photographs of Lamello Junior.
Lamello minilo brochure, date unknown, entitled "Hardly believable, it's so easy, and the job is finished so quickly.".
Lamello 2000 brochure, date unknown.
*Northern Woods,* Issue No. 12, Spring Quarter 1988, article entitled "Plate Joinery", by Annette Weir.
*Popular Science,* Dec. 1973, p. 119, showing Craftsman jigsaw (top right quarter of page).
*Popular Woodworking,* Jun./Jul. 1987, p. 23, entitled "Is There a Plate Joiner in Your Future" by Hugh Foster.
Porter–Cable ad, date unknown: "News—3 New Products from Porter–Cable".
Porter–Cable Instruction Manual for Double Insulated Plate Joiner, Model 555.
Porter–Cable—Parts list for Plate Joiner Model No. 555, © 1987, Porter–Cable.
ShopSmith® instruction manual for Biscuit Joiner 555320, Sep. 1988.
Virutex brochure, date unknown, entitled "ensamblador o=81".
*Woodshop News,* Dec. 1988, "Products and Services".

* cited by examiner

PLATE JOINER

This application is a Continuation of application Ser. No. 08/872,015, filed Jun. 9, 1997, which application(s) are incorporated herein by reference.

BACKGROUND AND SUMMARY OF THE INVENTION

The present invention relates to a plate joiner including a fence support, a drive, and a fence system. The fence support includes a cutter and a contact surface, which defines a cutter slot. The cutter is arranged and configured to protrude from fence support through cutter slot to make a plunge cut into a surface of a workpiece when the contact surface is pressed against the surface and the cutter is plunged into the workpiece by pushing on a rearward handle portion of the tool. The drive is arranged and configured to rotatably drive the cutter through a motor.

A preferred fence system includes an angle adjustment system arranged and configured to position the fence at a wide range of fence angles and, at any selected distance from a top face of the workpiece to the fence, the distance from the top face of the workpiece to the cutter remains constant as the front fence angle is adjusted. A preferred fence system includes a trunnion which pivotally couples the front fence to the fence system. A preferred fence system also includes an angle segment member, which has two slots used to position the fence in two ranges of fence angles.

DETAILED DESCRIPTION OF THE PREFERRED EMBODIMENT

Figure 1:
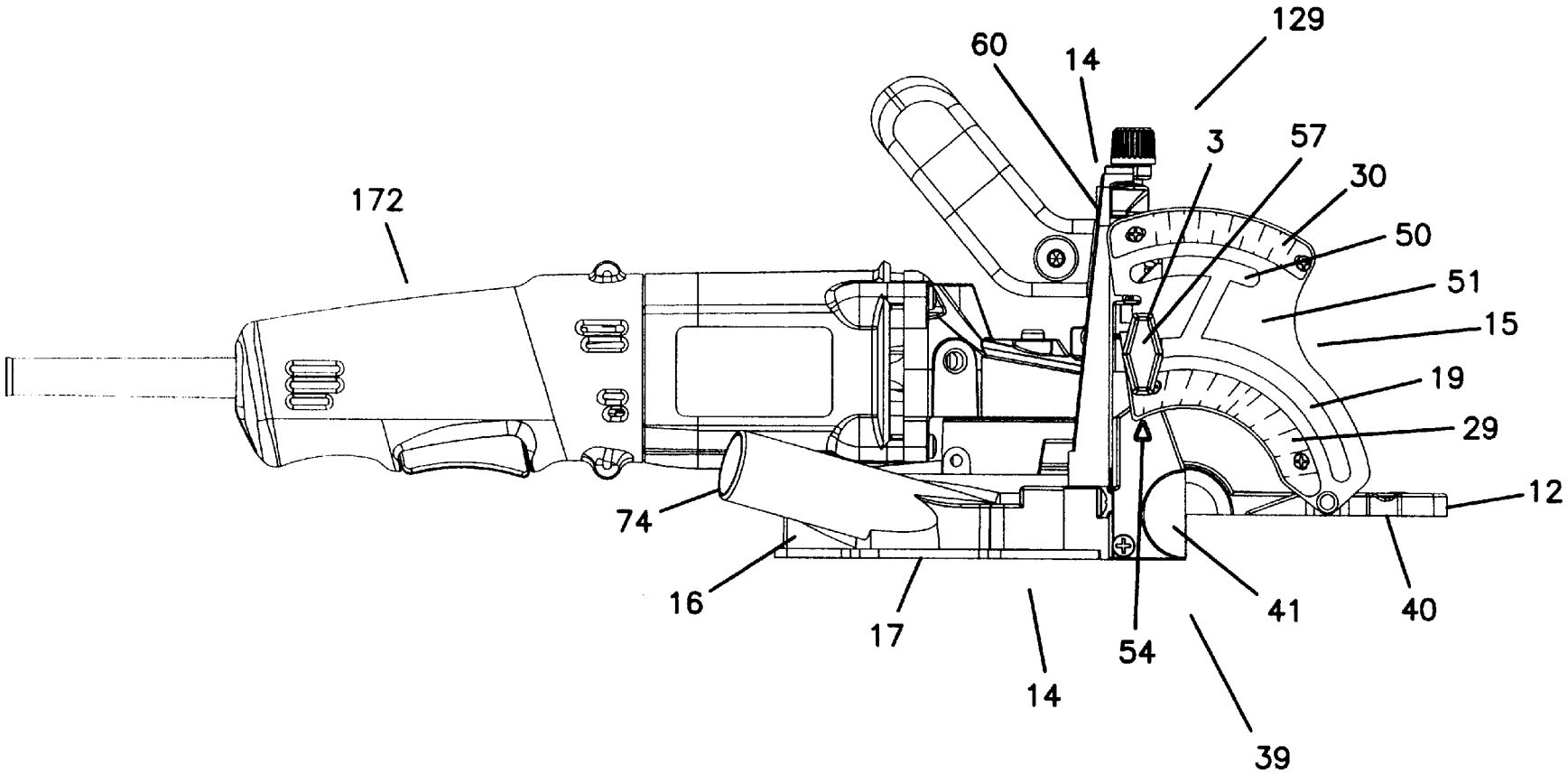
FIG. 1 illustrates a side elevational view of a preferred embodiment of the present plate joiner and fence system.
Figure 2:
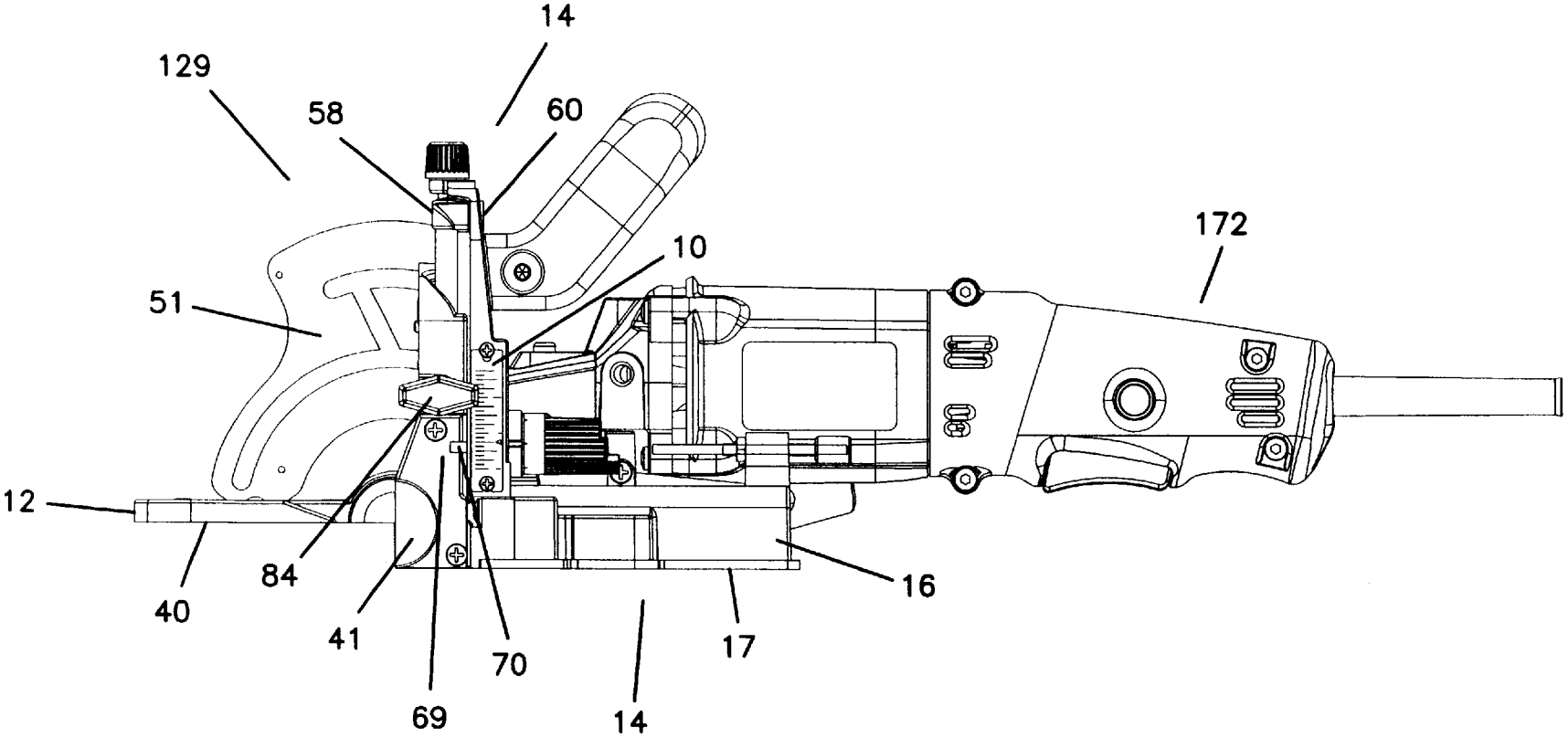
FIG. 2 illustrates a left side elevational view of the plate joiner and fence system shown in FIG. 1.
Figure 3:
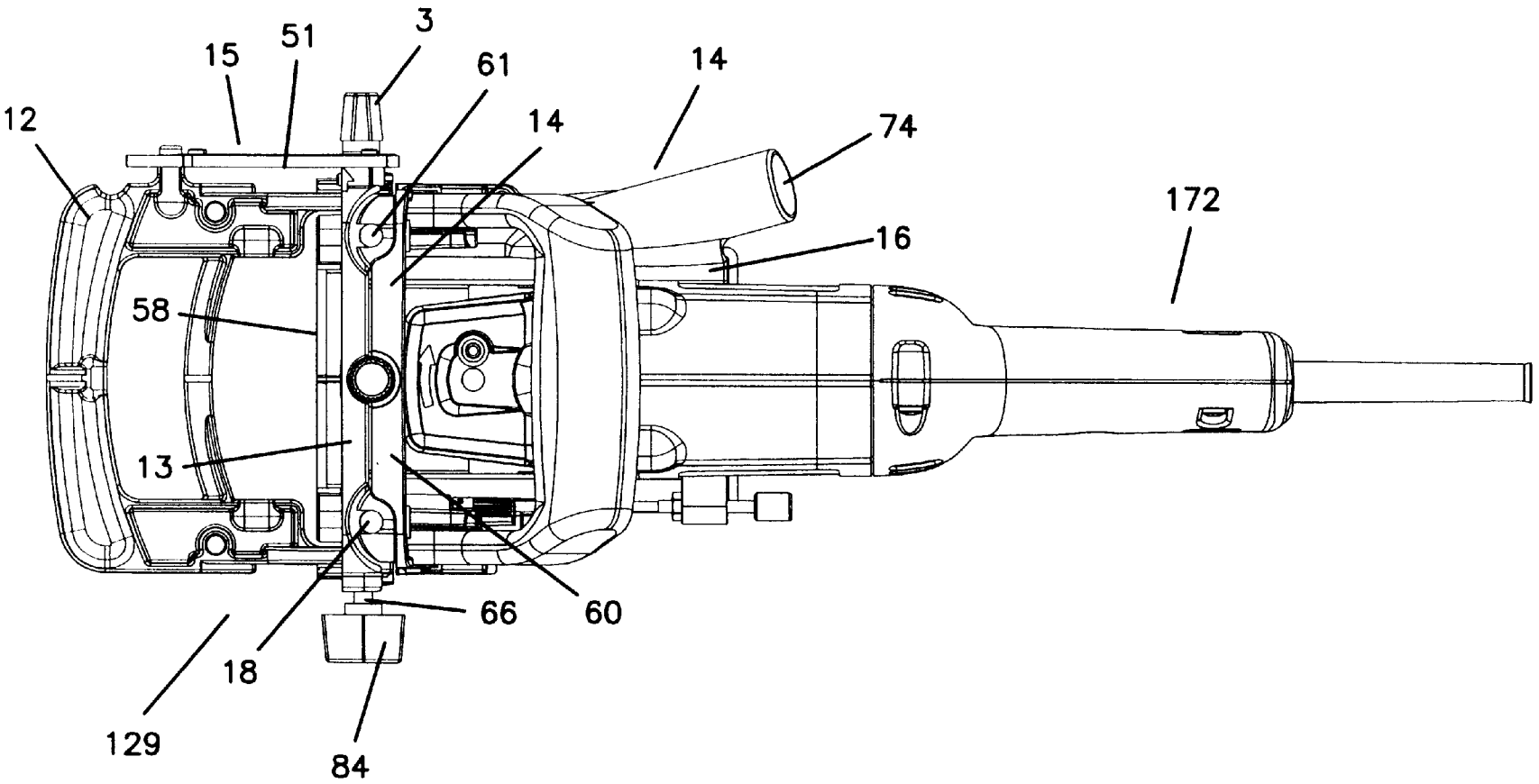
FIG. 3 shows a top plan view of the plate joiner and fence system shown in FIG. 1.
Figure 4:
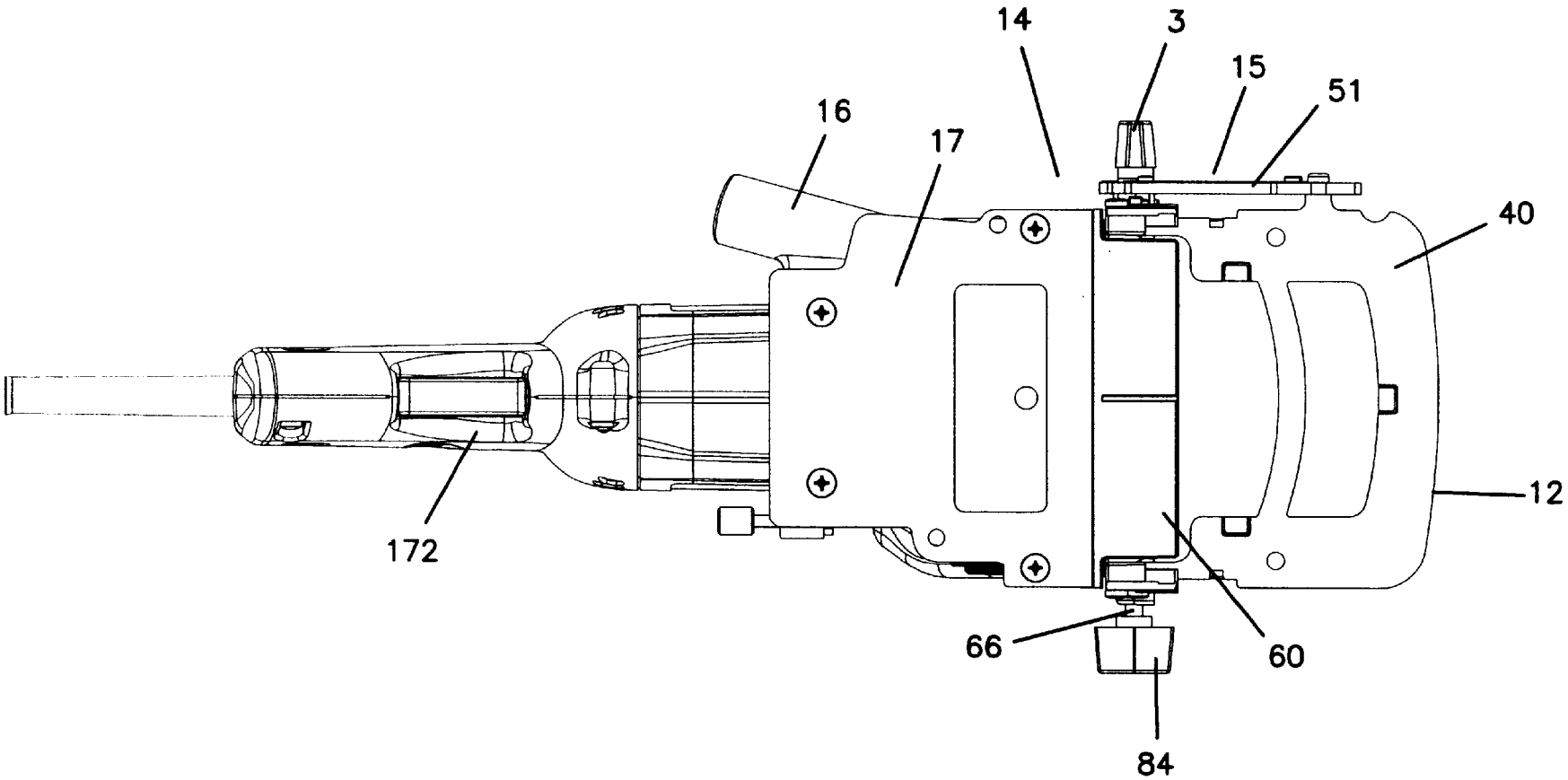
FIG. 4 shows a bottom plan view of the plate joiner and fence system shown in FIG. 1.
Figure 5:
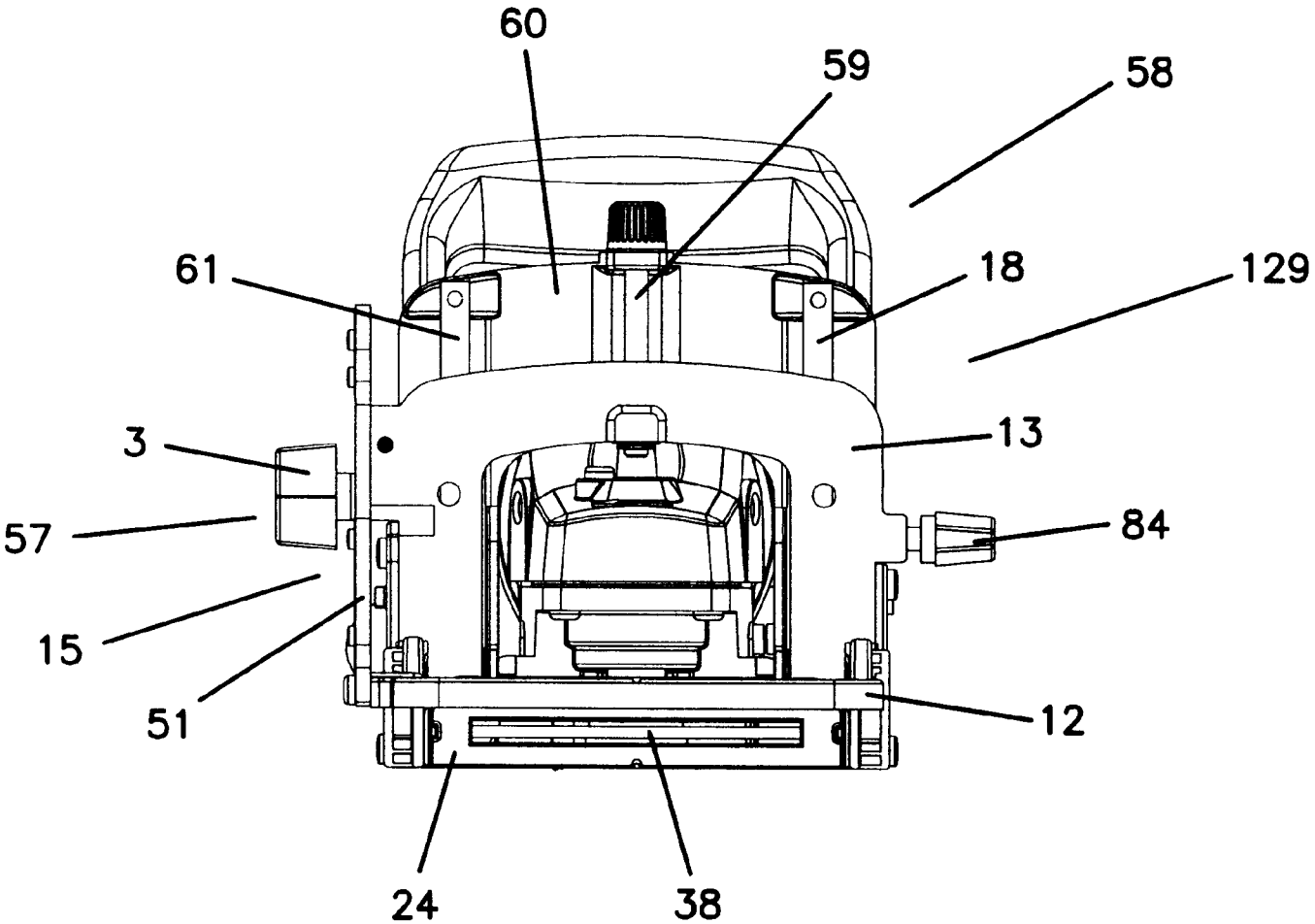
FIG. 5 shows a front elevational view of the plate joiner and fence system shown in FIG. 1.
Figure 6:
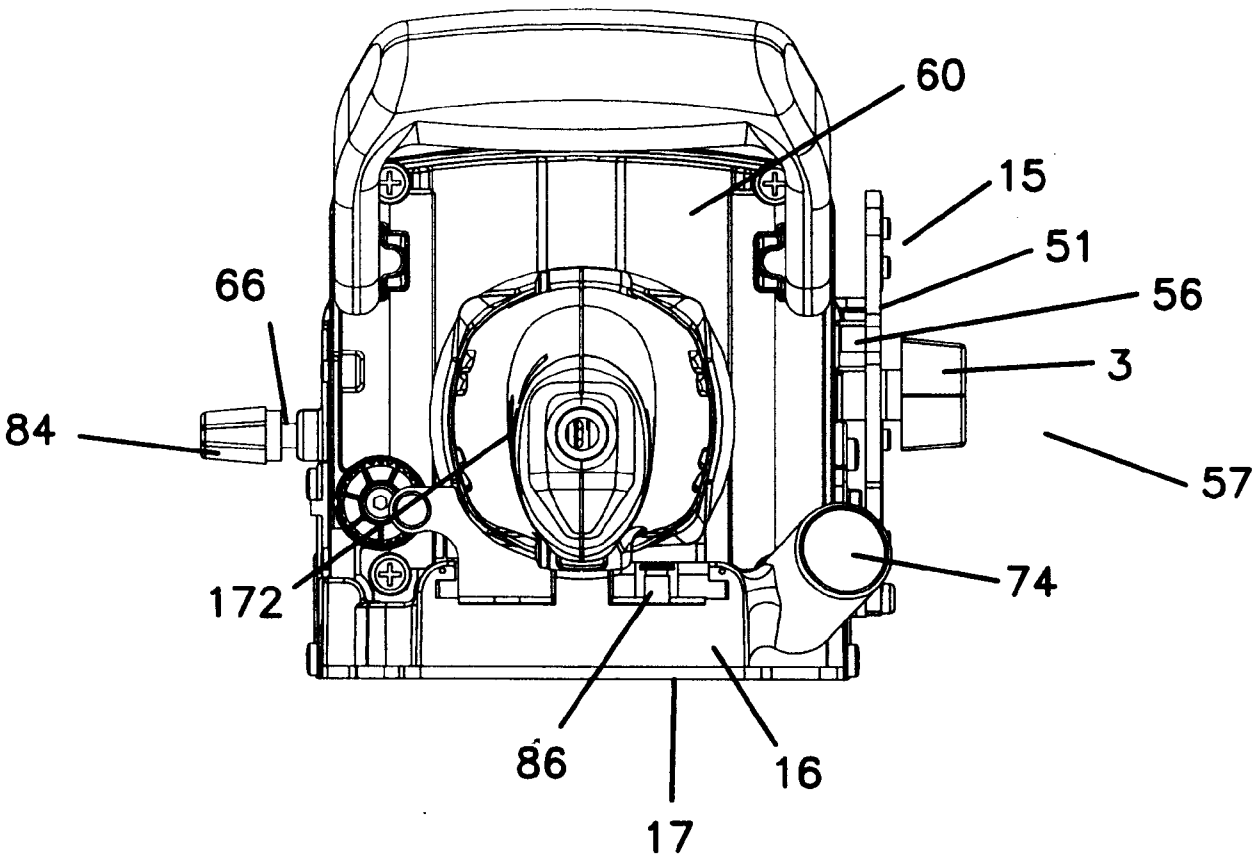
FIG. 6 shows a back elevational view of the plate joiner and fence system shown in FIG. 1.
Figure 7:
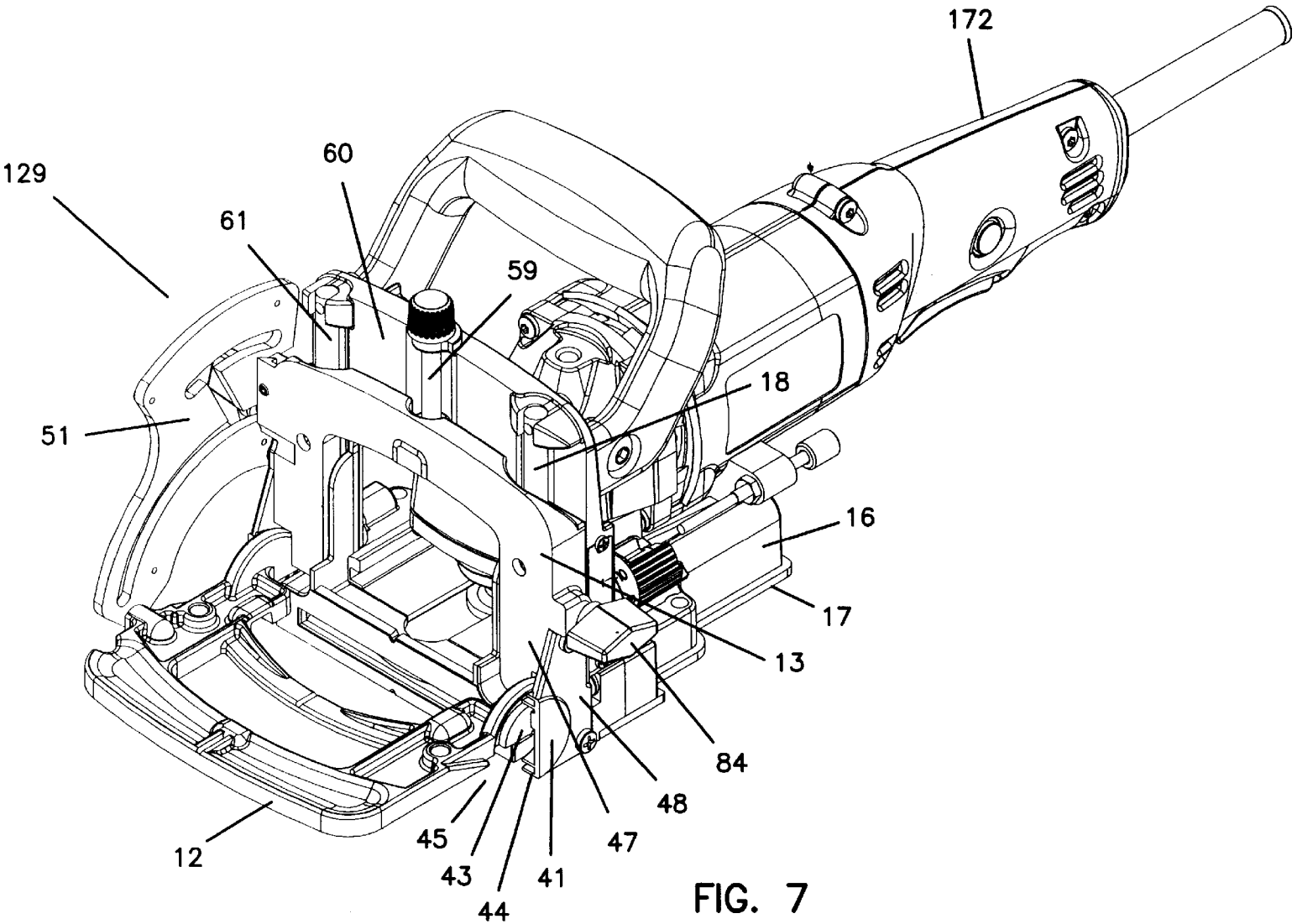
FIG. 7 shows a top left perspective view of the plate joiner and fence system shown in FIG. 1.
Figure 8:
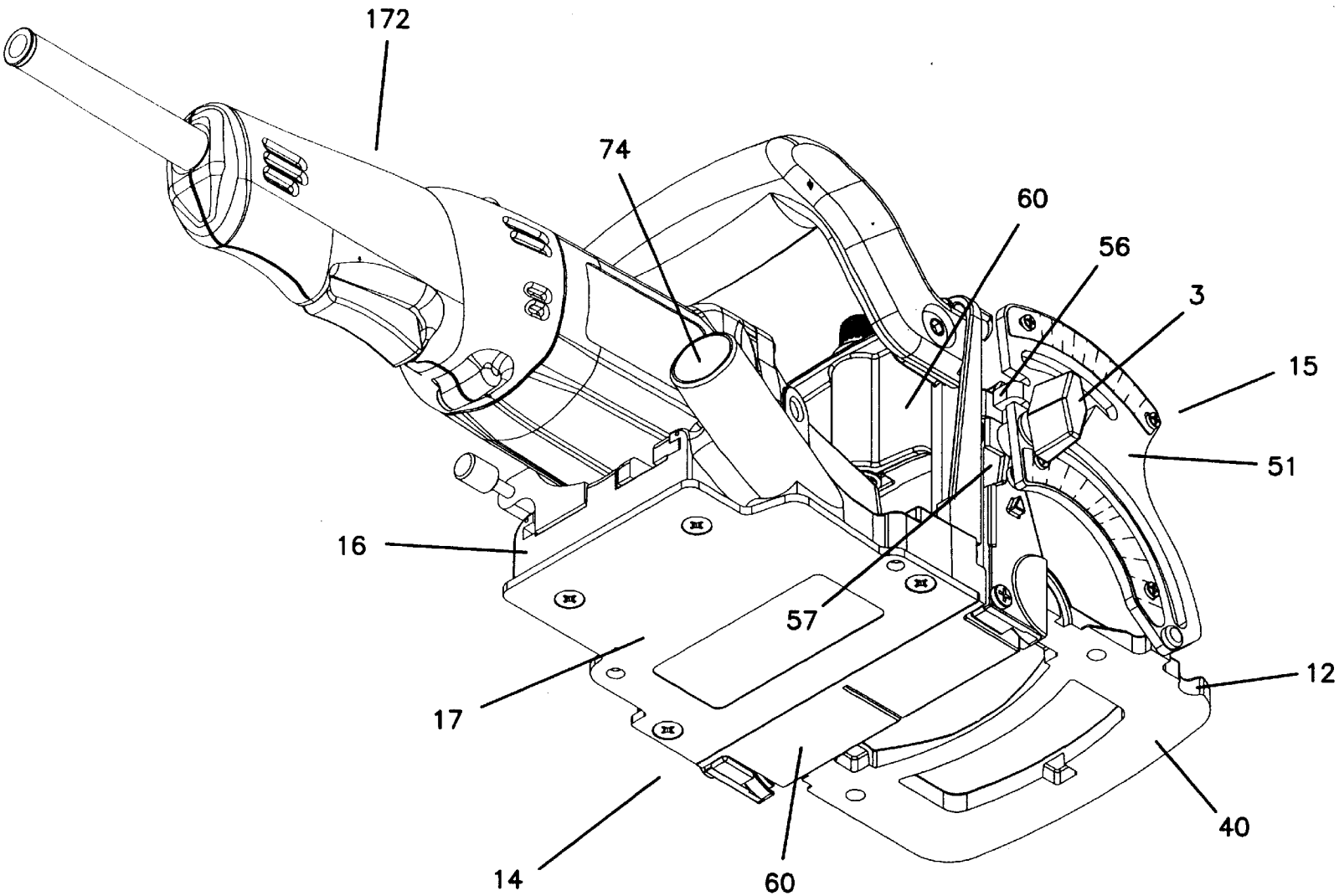
FIG. 8 shows a bottom right perspective view of the plate joiner and fence system shown in FIG. 1.

A plate joiner makes a plunge cut in a joint surface of a piece of wood which allows the piece of wood to be joined to another piece of wood having an oppositely disposed groove. A biscuit (a thin plate of wood or other material) and glue are placed in the grooves, and the pieces of wood are joined to provide an accurate and strong joint. A plate joiner generally includes a housing, a drive unit, and a rotating cutter. A portion of the housing contacts a joint surface and, as a portion of the housing is pushed forward, the rotating cutter moves forward, engages the joint surface at the desired location, and cuts into the joint surface. Releasing forward pressure on the housing then retracts the cutter. Thus, a plate joiner provides an easy method of producing a strong and aesthetic joint in wood.

The cutter is driven by a drive including a motor located within the housing, and a gear system driven by the motor and located in a forward gear housing portion of the housing. The gear system includes a motor driven shaft rotatably driven by the motor, a generally right angle coupling of the motor driven shaft, using beveled gear, to a cutter shaft that rotatably drives the cutter. The rotating cutter is configured to cut into the joint surface.

The preferred plate joiner tool can be configured into many highly versatile configurations. The plate joiner system is arranged and configured with a fence that can be positioned in a wide range of fence angles and, at any selected distance from a top face of the workpiece to the fence, the distance from the top face of the workpiece to the cutter remains constant as the front fence angle is adjusted. The plate joiner is configured for substantially continuous adjustment of fence height while restraining lateral and tortional movement of the fence and providing an accurate measure of the height of the fence from any point in the thickness of the blade. The plate joiner system is also arranged and configured to provide a plurality of release positions that reduce the distance traveled in making a plunge cut for a smaller blade and to prevent a blade from protruding from the tool in a release position. Such versatility is found in no other plate joiner system.

To accomplish this, the present plate joiner system preferably includes a fence system including an angle adjustment system having a trunnion and an angle segment member. The angle segment member includes two slots used to position the fence in two ranges of fence angles. The plate joiner system, preferably, also includes a height adjustment system including an adjustment screw arranged and configured to provide substantially continuous adjustment of fence height and guide pins which restrain lateral and tortional movement of the fence at the height it is adjusted and locked. A preferred plate joiner system also includes a cutter plunge system 86 arranged and configured for sliding the cutter from one of a plurality of release positions to a plunge position. A preferred plate joiner includes a cutter inside a removable cutter base cover.

Figure 9:
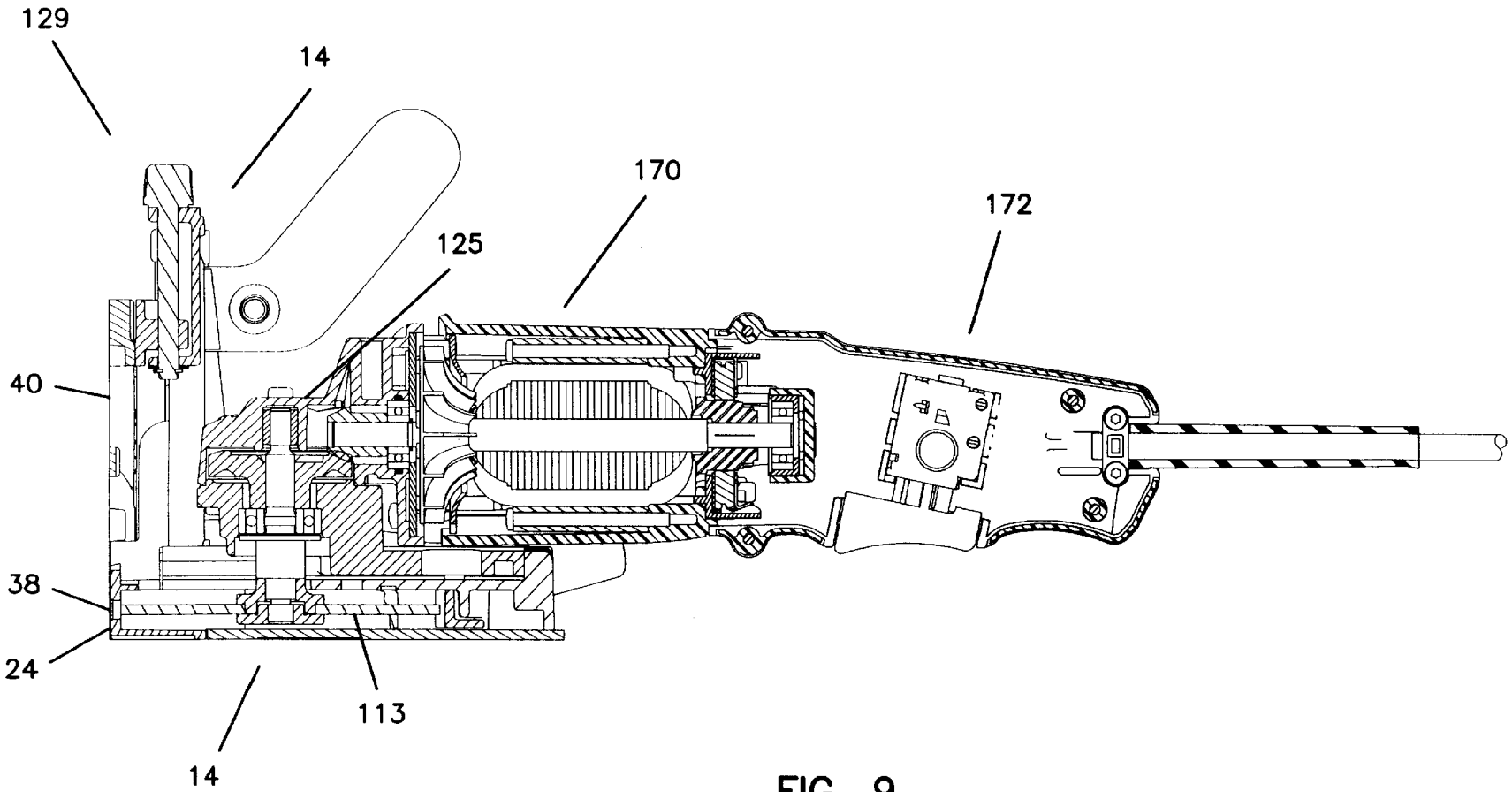
FIG. 9 shows a left elevational cross-sectional profile (taken along cutting line 8—8 of FIG. 6) illustrating the preferred plate joiner as well as a preferred fence system.

The preferred plate joiner system includes a fence support 14, a drive 170, and a fence system 129 (see FIG. 9). Preferred fence support 14 includes a cutter 113 and a contact surface 24, which defines a cutter slot 38. Cutter 113 is arranged and configured to protrude from fence support 14 through cutter slot 38 to make a plunge cut into a surface of a workpiece when contact surface 24 of fence support 14 is pressed against the surface and cutter 113 is plunged into the workpiece by pushing on a rearward handle portion 172 of the tool. Drive 170 is arranged and configured to rotatably drive cutter 113 through a motor which may be an electrical motor operated live or battery power, or which may be an air motor. In a preferred configuration, contact surface 24 includes abrasive, which provides stability of the surface against the work piece. For example, the grit of the abrasive contacts the workpiece and prevents motion of the tool relative to the workpiece.

A preferred fence system 129 includes a front fence 12 and an angle adjustment system 39, which is arranged and configured for adjusting an angle of front fence 12. Using this preferred fence system 129, at any selected distance from a top face of the workpiece to the front fence 12, the distance from the top face of the workpiece to cutter 113 remains constant as the angle of front fence 12 is adjusted. The preferred mechanism for accomplishing this is described further below.

Figure 13:
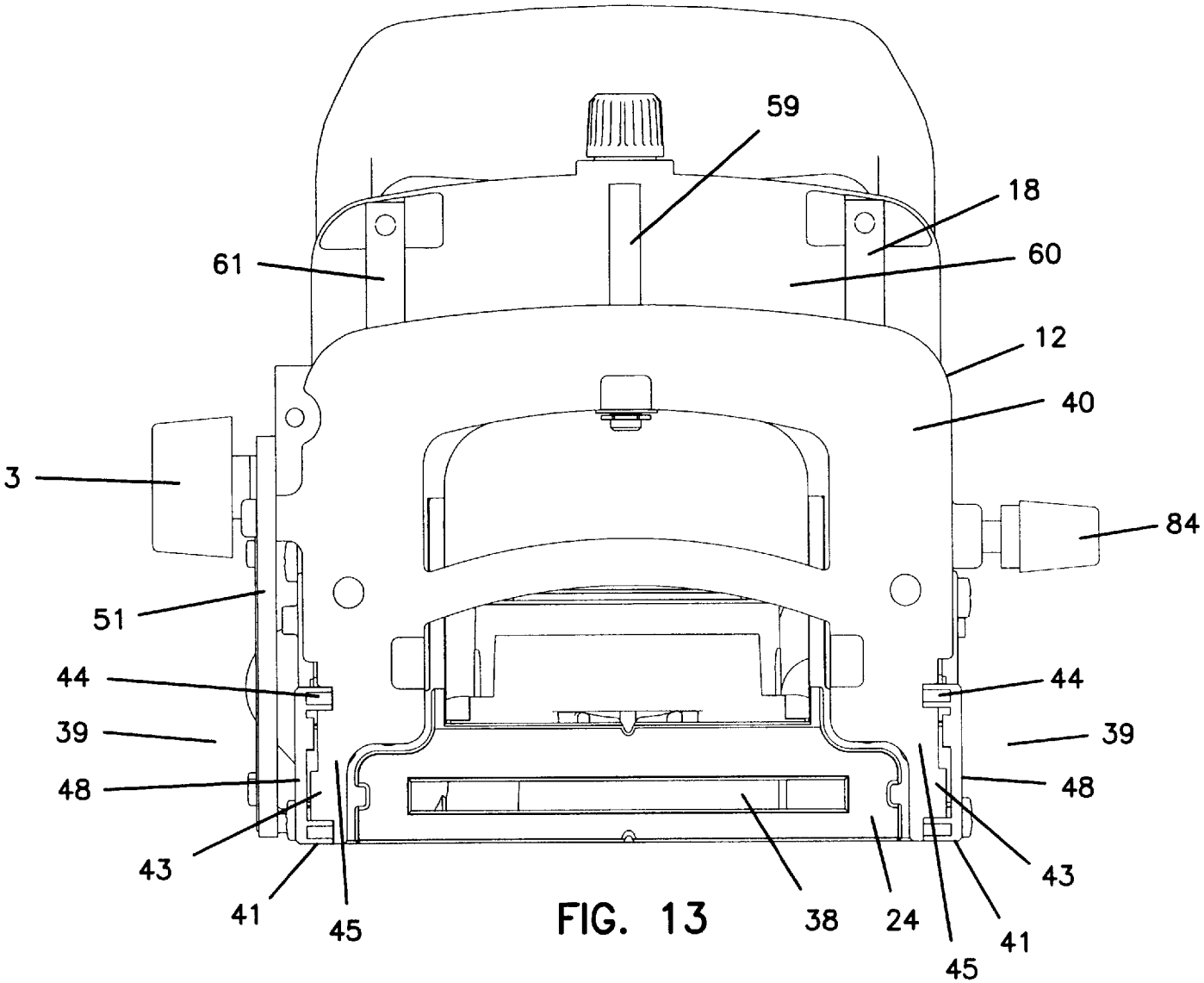
FIG. 13 shows a front elevational view of the fence system shown in FIG. 10.

Front fence 12 includes a planar face 40, which, at a fence angle of 0°, is coplanar with contact surface 24. At fence angles greater than 0°, planar face 40 of front fence 12 defines a plane that intersects with the plane of contact surface 24. The distance from this intersection to any particular part of cutter 113 is the distance from a top face of the workpiece to any particular part of cutter 113. As shown in FIG. 13, front fence 12 includes cut away portions so that from the front of the plate joiner, front fence 12 has a shape resembling a squared-off letter "A". The cut away portions of front fence 12 reduce the weight of the fence and, optionally, accommodate protruding portions of gear housing 125 when making a plunge cut.

Front fence 12 pivots with respect to fence support 14 and cutter 113 by employing angle adjustment system 39. Angle adjustment system 39 and front fence 12 define an axis on which front fence 12 pivots. When this pivot axis is not in the plane of contact surface 24, that is, when this pivot axis is in front of or behind the contact surface, the distance from the top face of the workpiece to any particular part of cutter 113 changes as the front fence angle is varied. Advantageously, angle adjustment system 39 and front fence 12 are arranged and configured to provide a pivot axis substantially in a plane defined by contact surface 24. This orientation of the pivot axis is a way to achieve a fence system in which, at any selected distance from a top face of the workpiece to any particular part of cutter 113, the distance from the top face of the workpiece to the particular part of cutter 113 remains constant as a front fence angle is adjusted.

Advantageously, angle adjustment system 39 employs a trunnion 41 to pivot front fence 12 on a pivot axis in a plane defined by contact surface 24. A trunnion typically includes a cup shaped receptacle which supports a rod or disk on which a device swivels. For example, the two opposite gudgeons on which a cannon swivels or pivots vertically form a trunnion. In this respect, a trunnion is particularly useful for providing a consistent vertical pivot motion without substantial lateral play.

Trunnion 41, in which a generally semicircular cup 42 receives a generally semicircular disk 43, is a mechanism that provides a pivot axis that is in the plane of contact surface 24. Cup 42 is defined by an arcuate ridge member 44. Disk 43, is a portion of groove member 45, which defines an arcuate groove 46 around disk 43. Arcuate groove 46 pivotally engages ridge member 44 in a manner such that disk 43 is retained in cup 42. Preferably, front fence 12 includes groove member 45 and rear fence 13 includes ridge member 44.

In the embodiment shown in the Figures, rear fence 13 includes a rear fence member 47 and a trunnion member 48, which includes groove member 45. Generally, ridge member 44 can be a component of either front fence 12 or rear fence 13, groove member 45 can be a component of whichever of front fence 12 or rear fence 13 does not include ridge member 44, and trunnion member 48 can include either ridge member 44 or groove member 45.

In the embodiment shown in the Figures, trunnion 41, includes left side trunnion pivot member 31 including ridge member 44 and groove member 45, and a right side trunnion pivot member 32 including ridge member 44 and a groove member 45. Generally trunnion 41 will include two trunnion pivot members, although a single member can include the features of both right side and left side trunnion pivot members.

Trunnion 41 can be arranged and configured to provide a pivot axis in a plane defined by contact surface 24, in a plane defined by planar surface 40 of front fence 12, in both of these planes, or in neither of these planes.

A preferred embodiment of the plate joiner system includes, as part of the system for adjusting the fence angle, an angle segment member 15 arranged and configured to position front fence 12 at a selected angle between a plane defined by planar surface 40 of front fence 12 and a plane defined by contact surface 24. Angle segment member 15 defines first slot 49 and second slot 50, which are arranged and configured to position the fence in a first and second range of fence angles, respectively.

Figure 10:
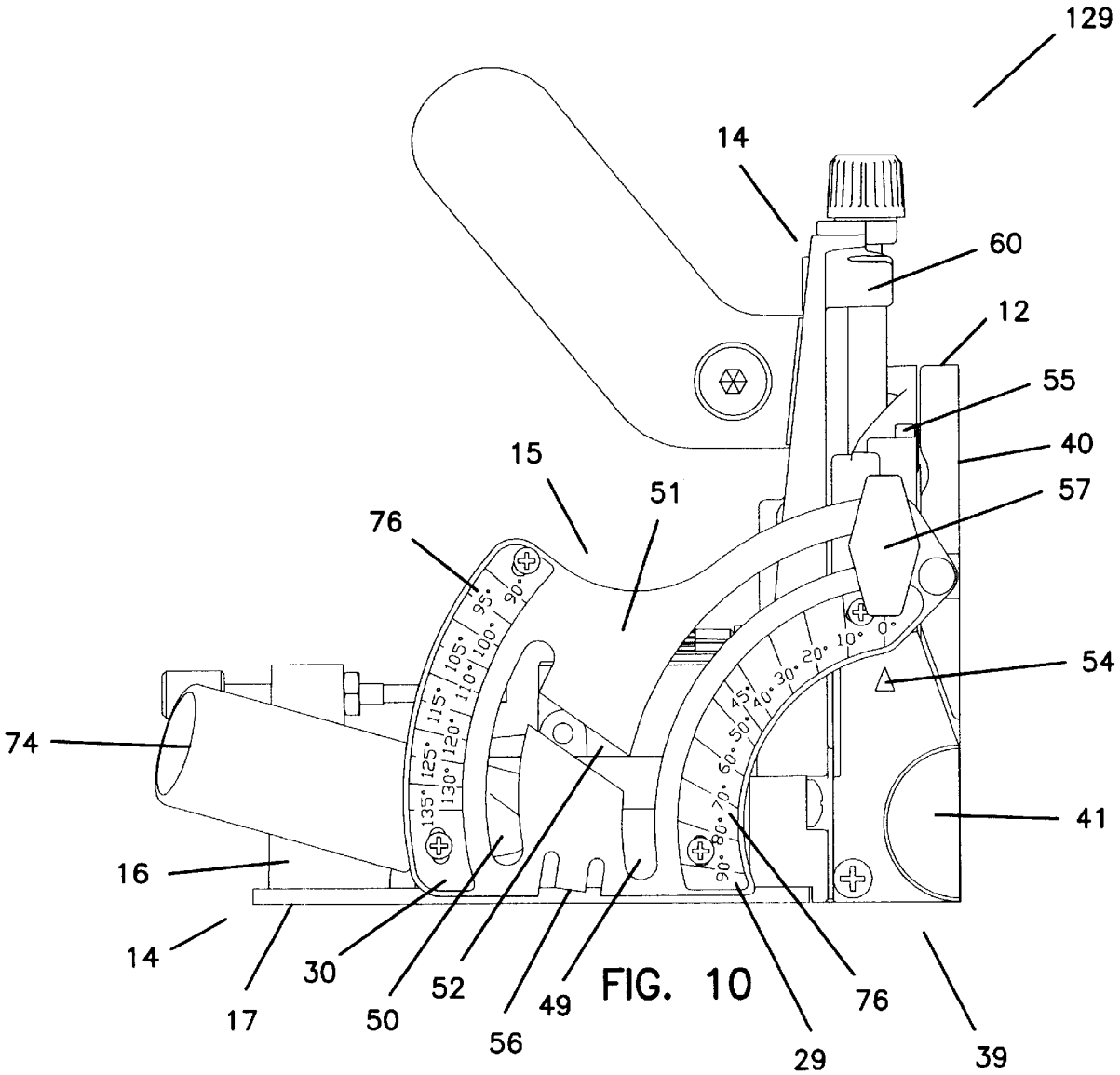
FIG. 10 illustrates a right elevational view of the fence system shown in FIG. 1.
Figure 11:
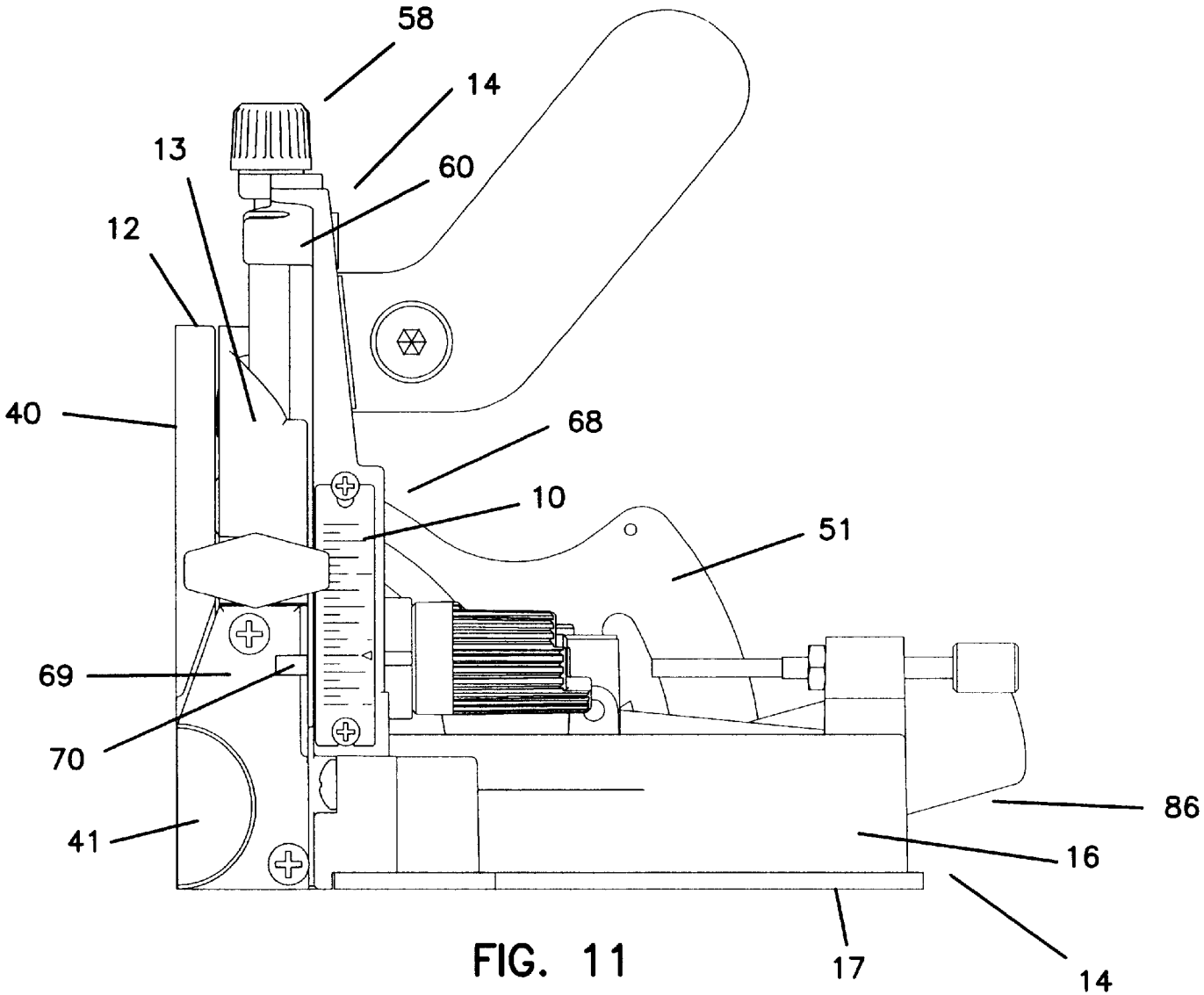
FIG. 11 shows a left elevational view of the fence system shown in FIG. 10.

FIG. 10 illustrates a preferred embodiment of angle segment member 15. In this embodiment, angle segment member includes a plate 51 pivotally coupled to front fence 12 and configured to define slots 49 and 50. First slot 49 and second slot 50 are each configured as an arcuate slot and are connected by third slot 52. In the embodiment shown in FIG. 10, the first range of fence angles is about 0° to about 90°, and the second range of fence angles is about 90° to about 135°. First angle scale 29 and second angle scale 30 are generally parallel to the corresponding slots and include numerical indicia 76 arranged and configured to indicate the angle of front fence 12. Slots 49 and 50 are arranged and configured to provide approximately evenly spaced indicia 76 for a given change in fence angles. FIG. 10 illustrates approximately evenly spaced indicia 76 for each 10° change in fence angle.

First angle scale 29 and second angle scale 30 are each associated with an angle indicator, first angle indicator 54 and second angle indicator 55, respectively. When front fence 12 is positioned in the first range of fence angles, first angle indicator 54 is generally adjacent to first angle scale 29 and indicates the fence angle on first angle scale 29. When front fence 12 is positioned in the second range of fence angles, second indicator 55 is generally adjacent to second angle scale 30 and indicates the fence angle on second angle scale 30.

Advantageously, first angle indicator 54 is not adjacent to first angle scale 29 when front fence 12 is positioned in the second range of fence angles. That is, angle segment 15 moves so that first angle indicator 54 is dissociated from first angle scale 29 when front fence 12 is positioned in the second range of fence angles (see FIG. 22). Similarly, second angle indicator 55 is not adjacent to second angle scale 30 when front fence 12 is positioned in the first range of fence angles. That is, angle segment 15 moves so that second angle indicator 55 is dissociated from second angle scale 30 when front fence 12 is positioned in the first range of fence angles (see FIG. 10).

In another preferred embodiment, angle adjustment system 39 is arranged and configured to provide a positive stop at one or more fence angles. For example, angle segment member 15 can include a stop member, such as tab 56, that contacts another portion of the fence system to provide a positive stop. Such a positive stop can be adjustable if either tab 56 or the part contacted by tab 56 includes a stop adjustment mechanism, such as an adjustable set screw.

Figure 12:
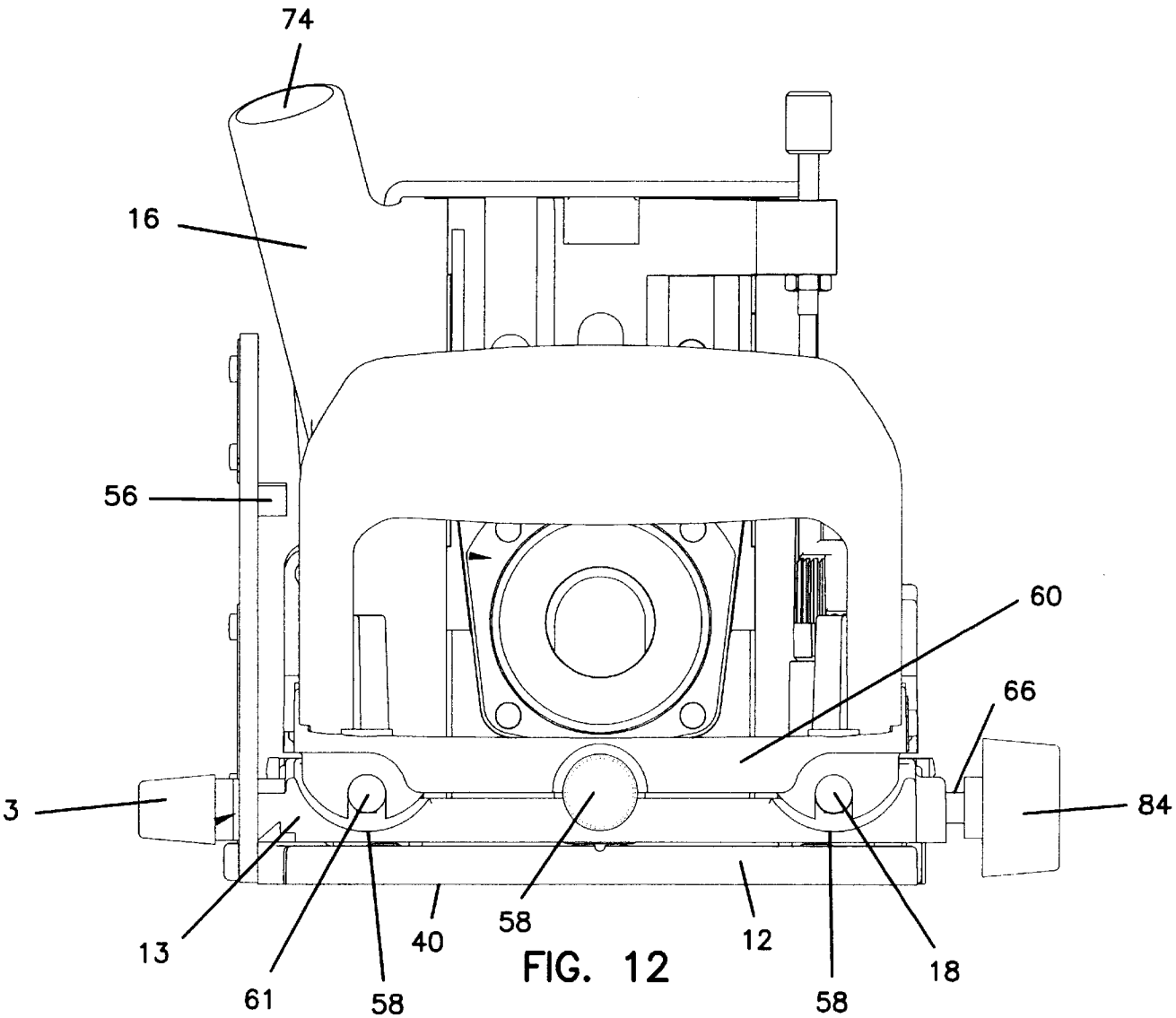
FIG. 12 shows a top plan view of the fence system shown in FIG. 10.
Figure 14:
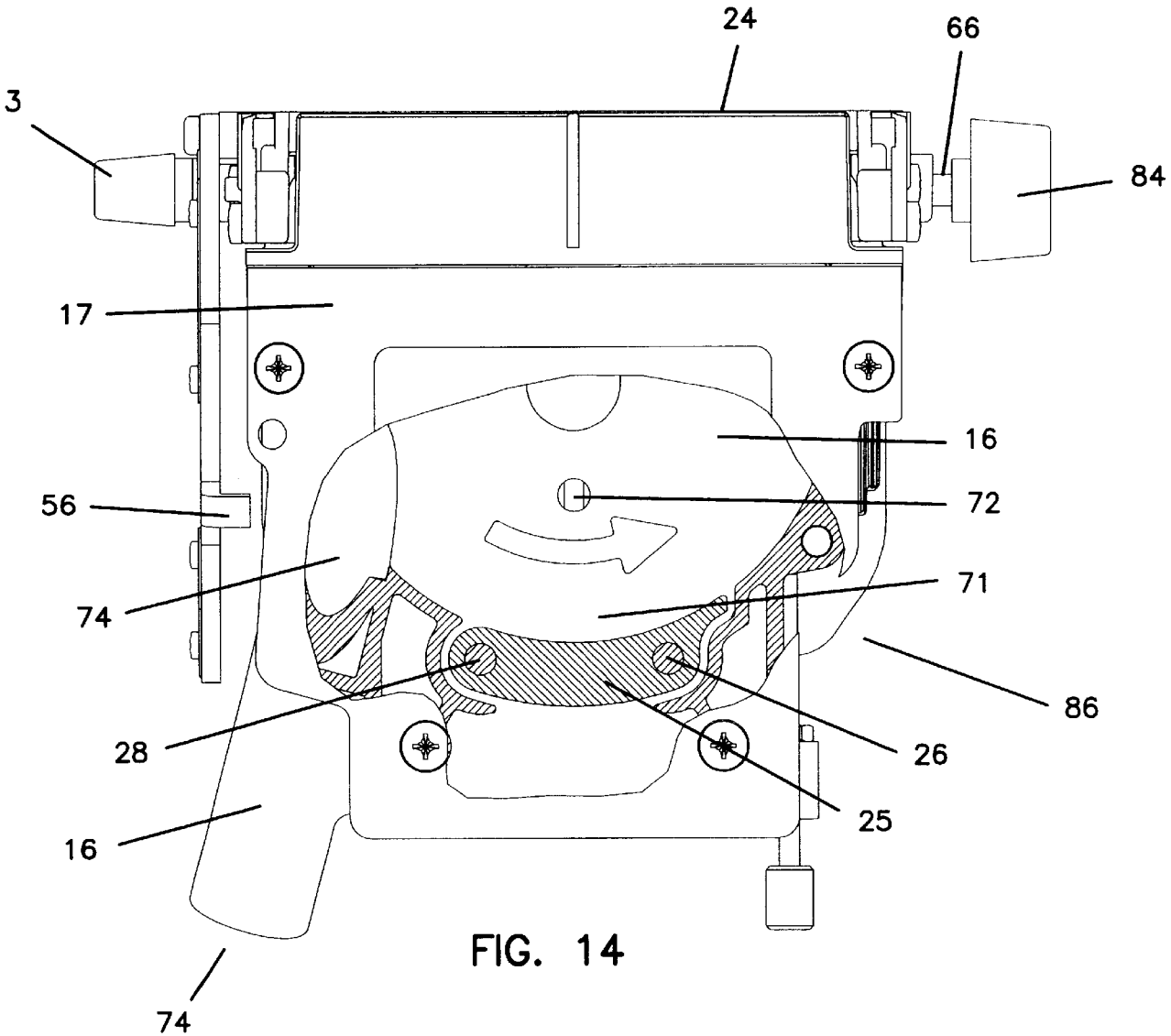
FIG. 14 illustrates a bottom plan view of the fence system shown in FIG. 10, with a portion of the cutter cover base cut away.
Figure 15:
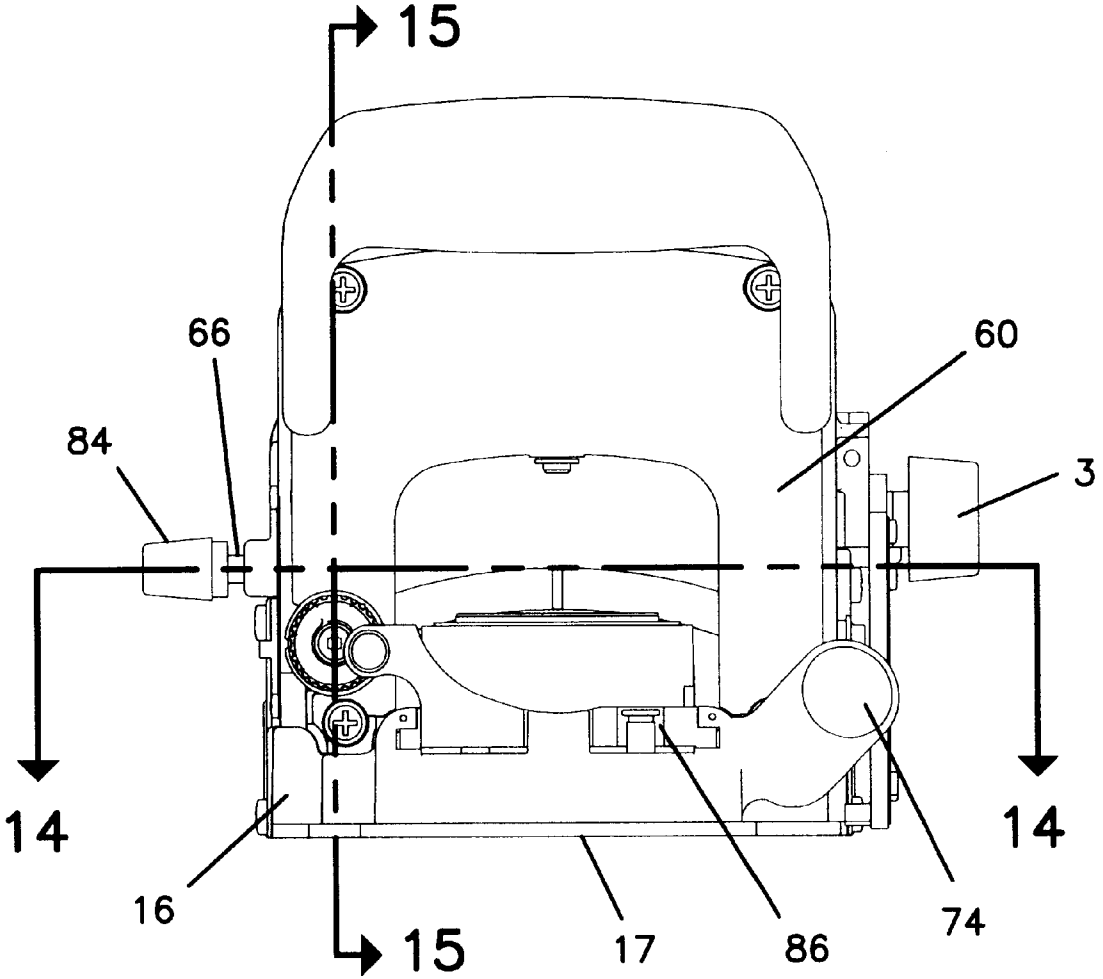
FIG. 15 shows a rear elevational view of the fence system shown in FIG. 10.

FIGS. 12 and 14 show stop member 56 configured to provide a positive stop at 90°. Using first slot 49 to position front fence 12 at 90° brings stop member 56 into contact with rear fence 13 providing a positive stop. Optionally, rear fence 13 can include an adjustable set screw (not shown) at the point at which stop member 56 contacts rear fence 13 to provide an adjustable positive stop. It is advantageous to provide an adjustable stop at 90° so that plunge cuts can be adjusted to be made accurately at substantially 90°. An analogous arrangement of stop member 56 and contact point on rear fence 13 can provide a positive stop at 135° (not shown). A positive stop at 0° is provided by contact between rear fence 13 and a contact point 78 on the rearward surface of front fence 12.

Front fence 12 can be retained at a desired fence angle. Angle adjustment system 39 includes an angle locking system 57. Angle locking system 57 includes angle locking knob 3 that is arranged and configured to bias against angle segment member 15. Angle locking knob 3 is threadably engaged on a pin (not shown) that slidably engages slots 49 and 50 in angle segment member 15. Knob 3 when tightened on the threaded pin biases angle segment member 15 against rear fence 13.

The preferred plate joiner system includes a height adjustment system 58, which is a subsystem of fence system 129. Height adjustment system 58 is preferably arranged and configured to adjust the distance from the top face of a workpiece to the cutter in a substantially continuous manner and with torsional and lateral stability. optionally, height adjustment system 58 can provide a combination of rapid, discontinuous height adjustment to approximately the desired fence height, and substantially continuous adjustment to achieve the desired fence height.

Height adjustment system 58 achieves substantially continuous adjustment of fence height using a threaded rod 59. Threaded rod 59 is supported by and rotatably retained by a vertical member 60 portion of fence support 14 and threadably engages rear fence 13. Vertical member 60 and rear fence 13 are both substantially perpendicular to cutter 113. Threaded rod 59 does not move vertically relative to vertical member 60, and as threaded rod 59 is rotated, rear fence 16 moves up and down relative to vertical member 60 and cutter 113. Since front fence 12 is pivotally attached to rear fence 13, front fence 12 also moves vertically with rear fence 13 and relative to cutter 113.

Threadable engagement of rear fence 13 with threaded rod 59 results in substantially continuous vertical adjustment of the fence. Small increments of rotation allow small increments of vertical movement on the incline of the threads. In a preferred embodiment, by knowing the pitch of the thread, each revolution or partial revolution provides a predetermined height adjustment Optionally, using a quick release screw 80 rear fence 13 can disengage from the threads of threaded rod 59, for rapid, discontinuous height adjustment. When the approximate fence height is achieved by discontinuous adjustment, rear fence 13 can reengage the threads of threaded rod 59 for continuous adjustment to the desired fence height.

Height adjustment is achieved with torsional and lateral stability by using first guide rod 61 and second guide rod 18 to guide vertical adjustment of rear fence 13. As shown in the Figures, first guide rod 61 and second guide rod 18 are components of fence support 14. Guide rod frames 62 and 63 are components of rear fence 13. In this way, guide rods 18 and 61 are retained by fence support 14 vertical member 60, and cannot move vertically relative to vertical member 60. Yet, guide rods 18 and 61 slidably engage rear fence 13, so that rear fence 13 can slide vertically relative to the guide rods for height adjustment.

Figure 16:
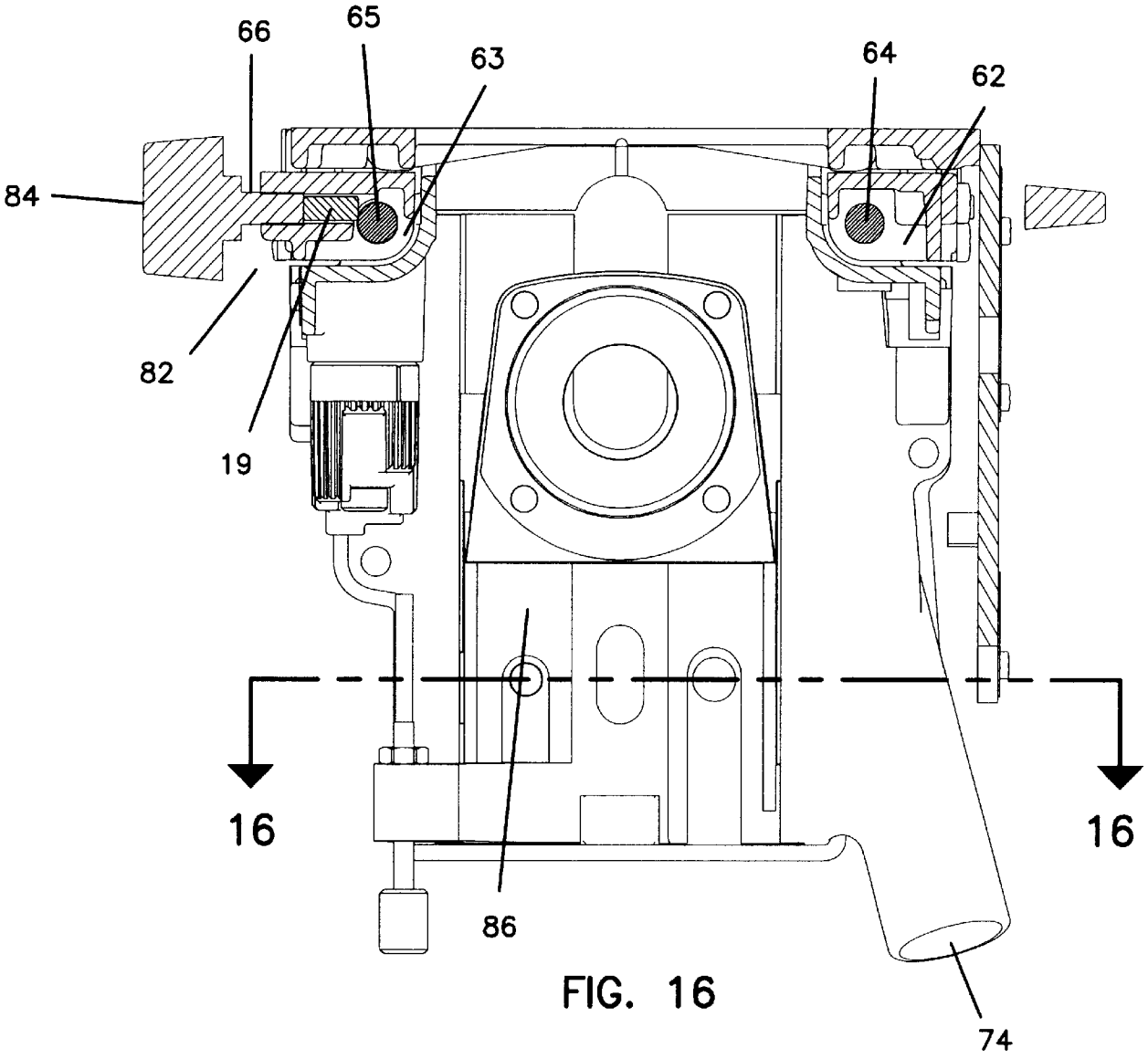
FIG. 16 shows a top plan cross-sectional profile (taken along cutting line 14—14 of FIG. 15) illustrating a preferred fence system.
Figure 17:
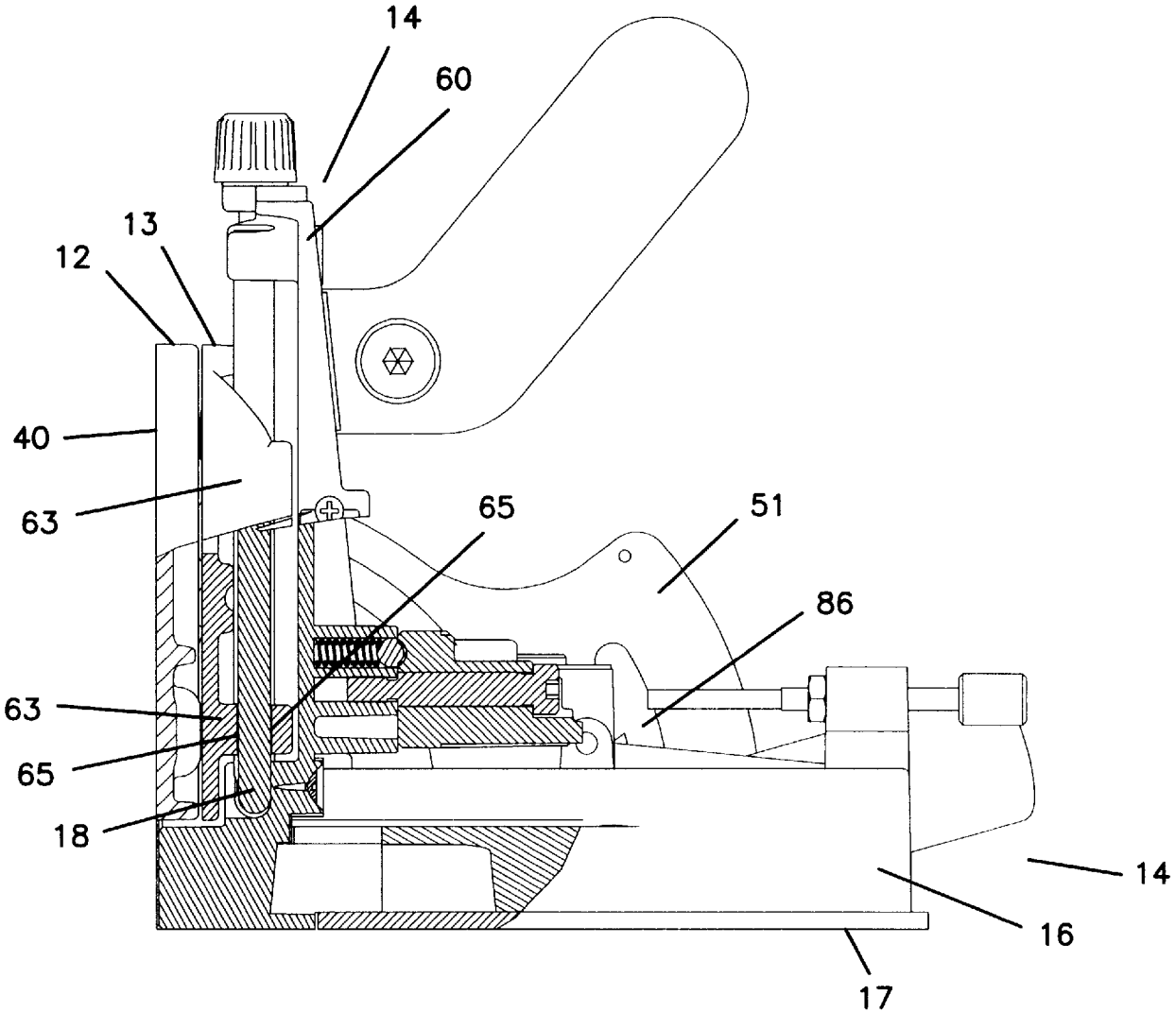
FIG. 17 shows a left side elevational cross-sectional profile (taken along cutting line 15—15 of FIG. 13) illustrating a preferred fence system.
Figure 18:
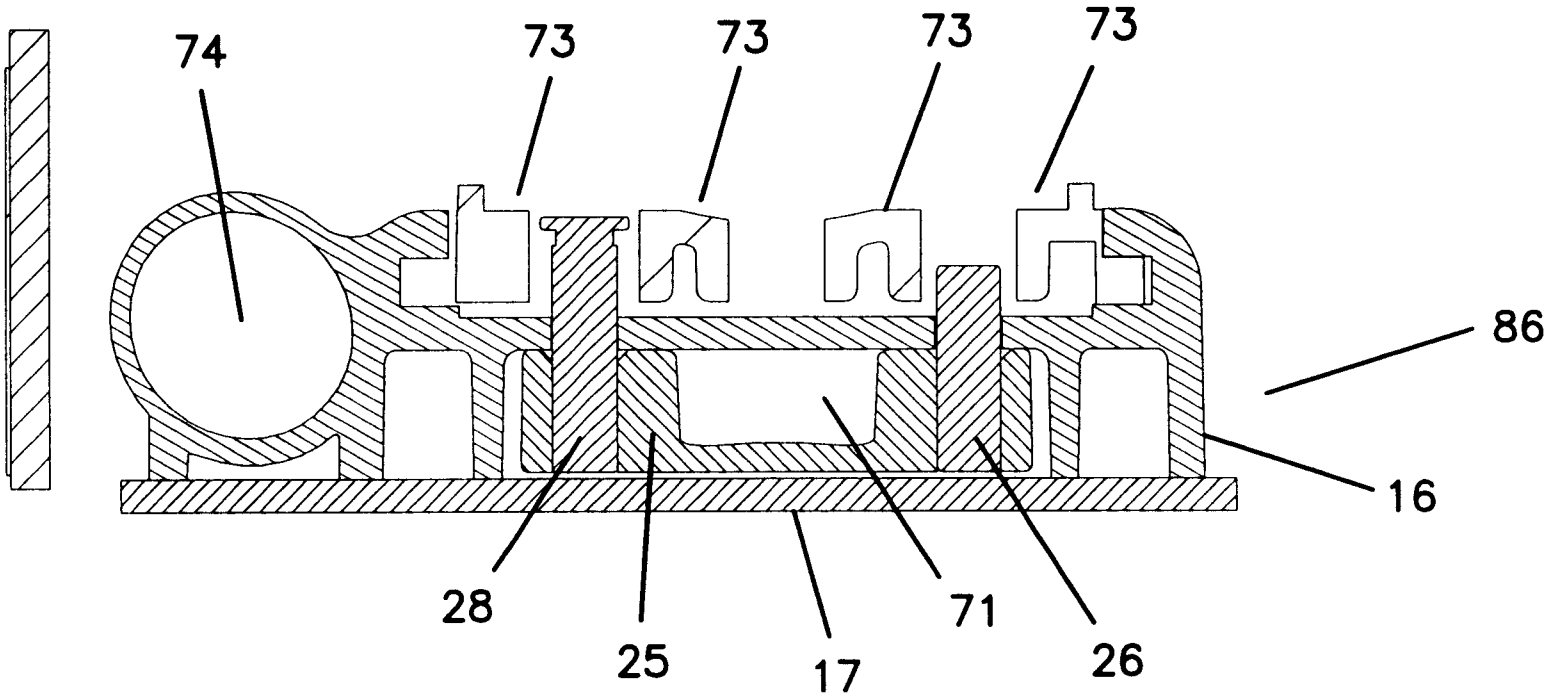
FIG. 18 illustrates a back elevational cross-sectional profile (taken along cutting line 16—16 of FIG. 16) illustrating a preferred fence system including portions of the lower gear housing of the plate joiner.
Figure 19A:
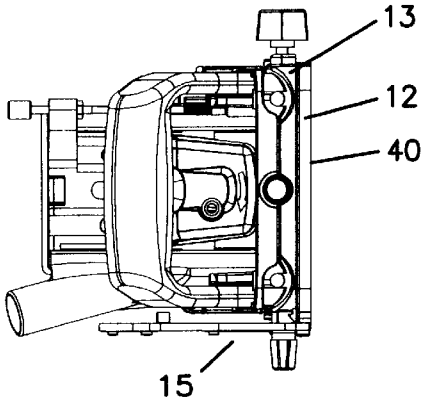
FIGS. 19A–E show elevational and top and bottom plan views of the fence system of FIG. 10 with the front fence at an angle of zero degrees.
Figure 19B:
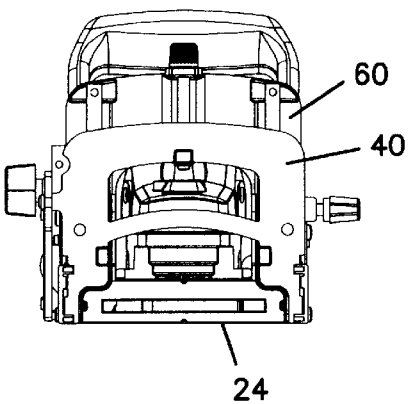
Figure 19C:
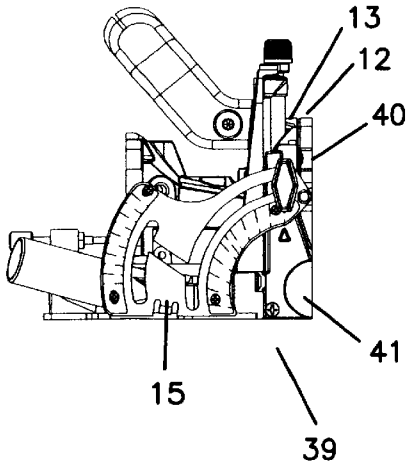
Figure 19D:
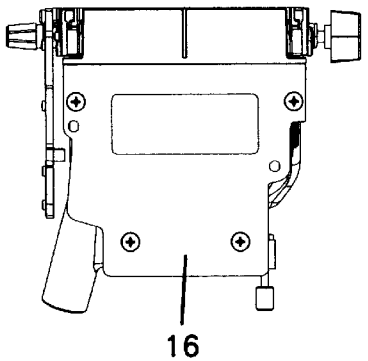
Figure 19E:
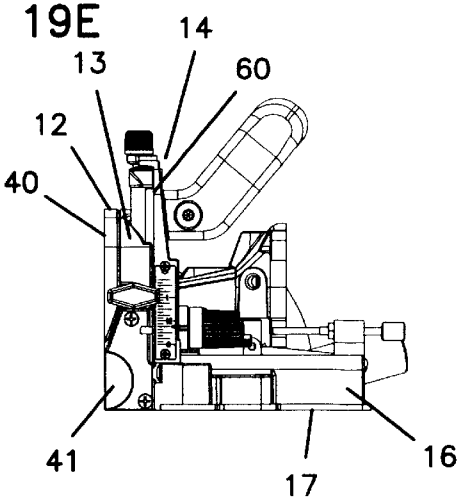
Figure 20D:
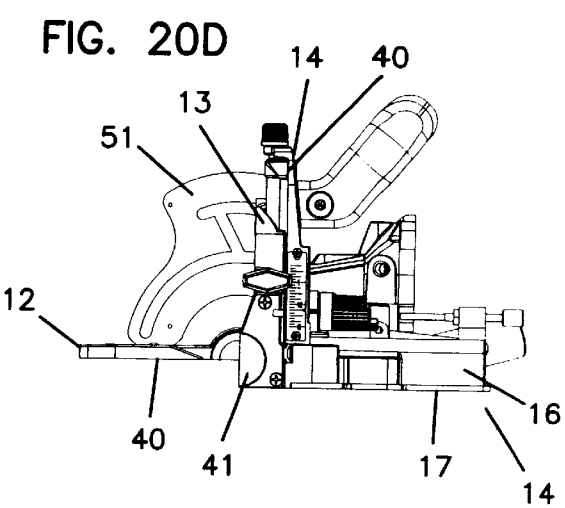
FIGS. 20A–E show elevational and top and bottom plan views of the fence of FIG. 10 with the front fence at an angle of 90 degrees in the first range of front fence angles.
Figure 20E:
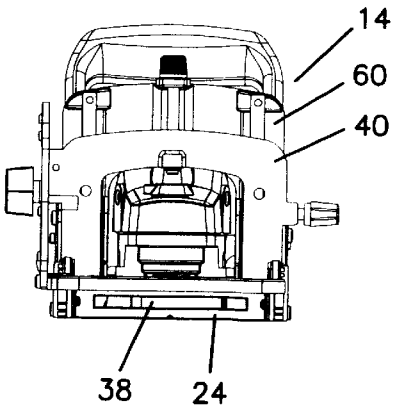
Figure 20C:
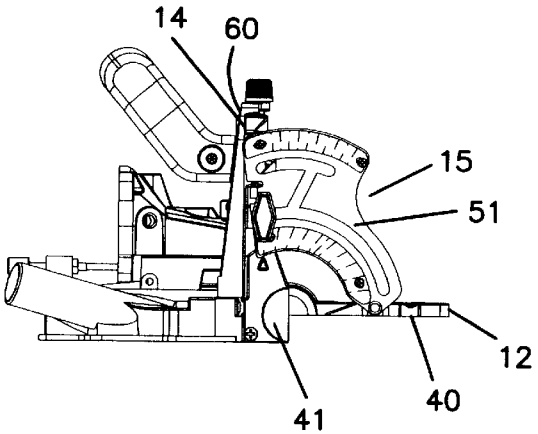
Figure 20A:
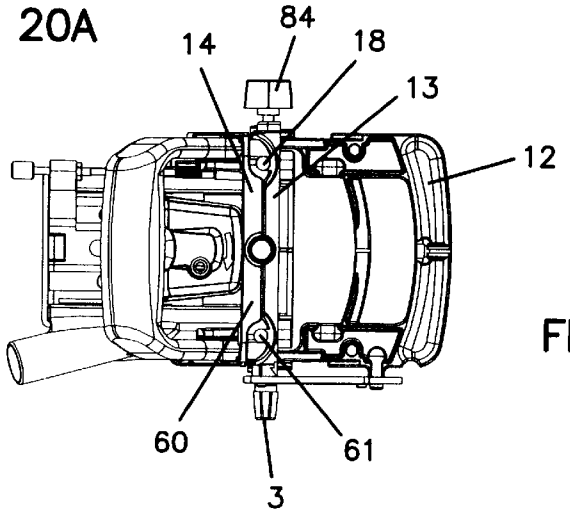
Figure 20B:
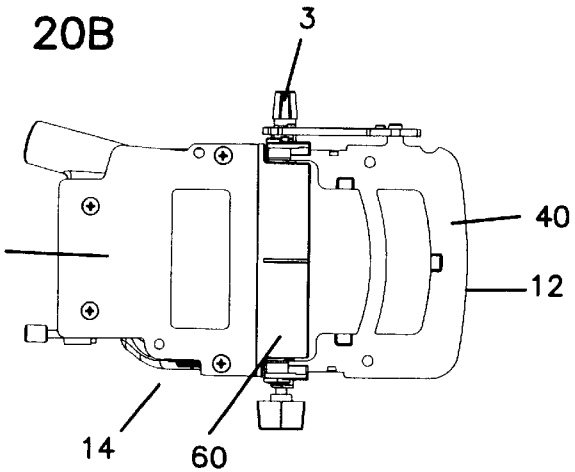
Figure 21D:
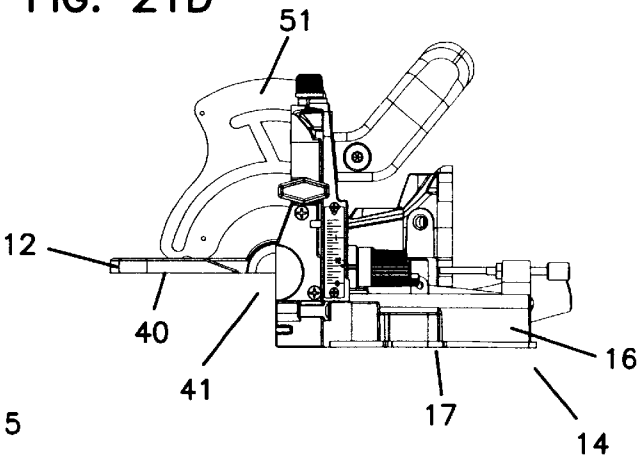
FIGS. 21A–E show elevational and top and bottom plan views of the fence system of FIG. 10 with the front fence at an angle of 90 degrees with the height of the front fence raised compared to the position in FIG. 20.
Figure 21E:
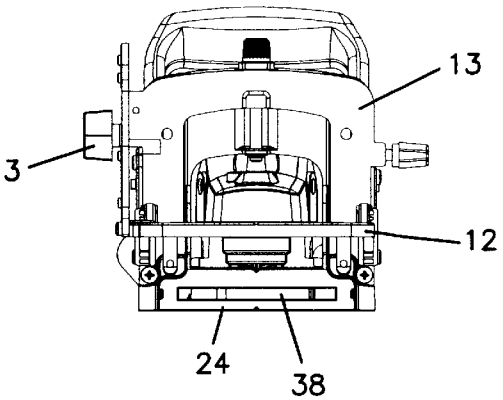
Figure 21C:
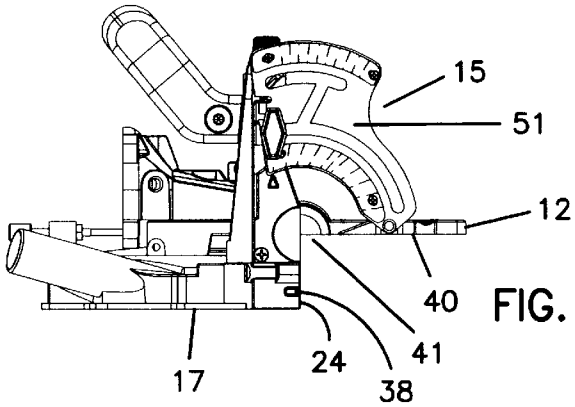
Figure 21A:
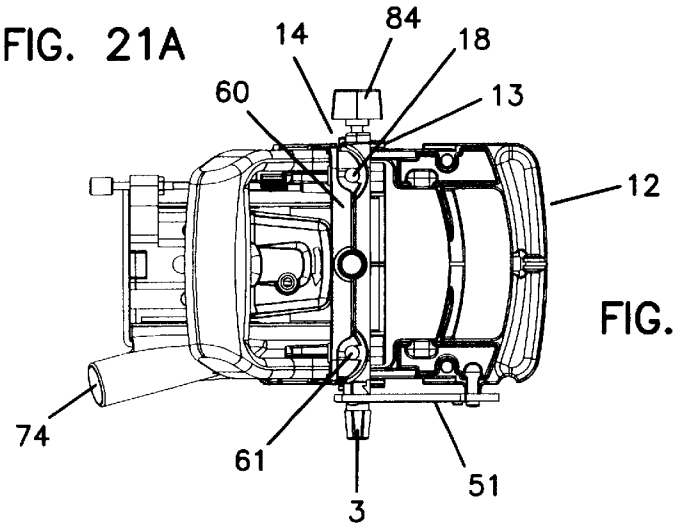
Figure 21B:
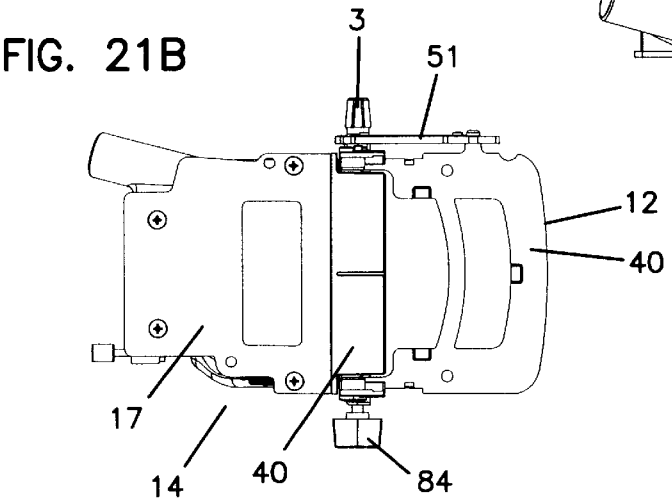
Figure 22A:
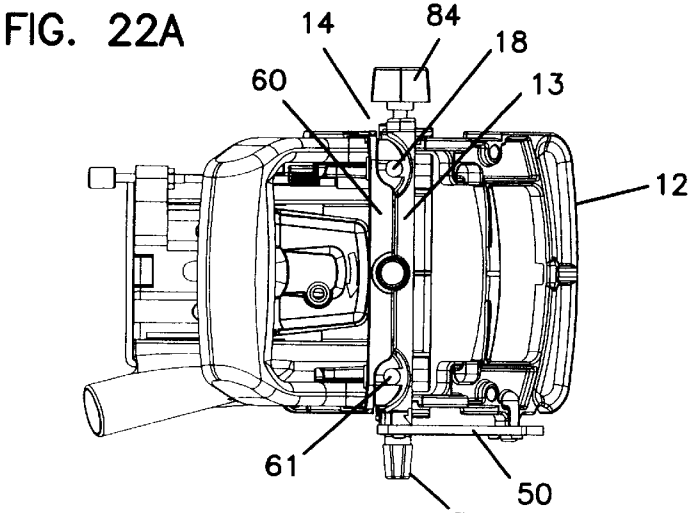
FIGS. 22A–D show elevational and top and bottom plan views of the fence system of FIG. 10 with the front fence at an angle of 135 degrees.
Figure 22C:
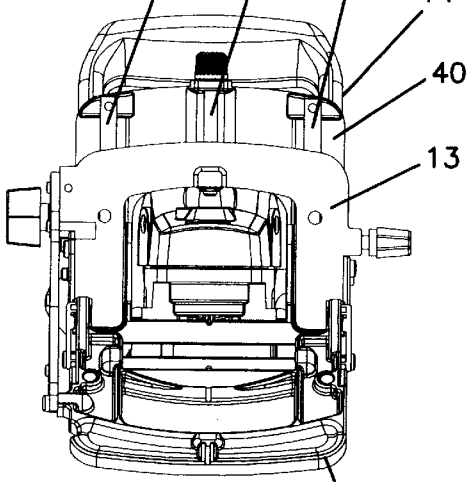
Figure 22B:
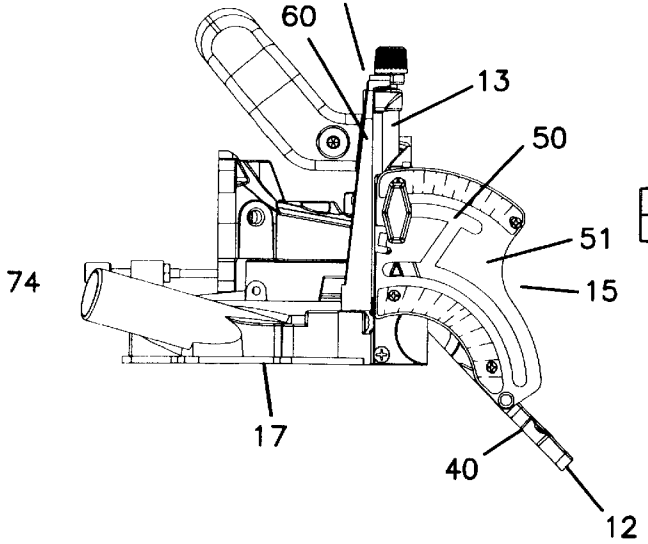
Figure 22D:
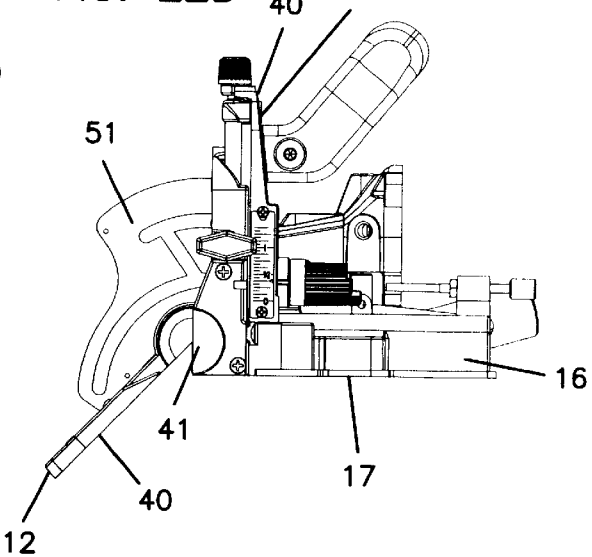
Figure 23:
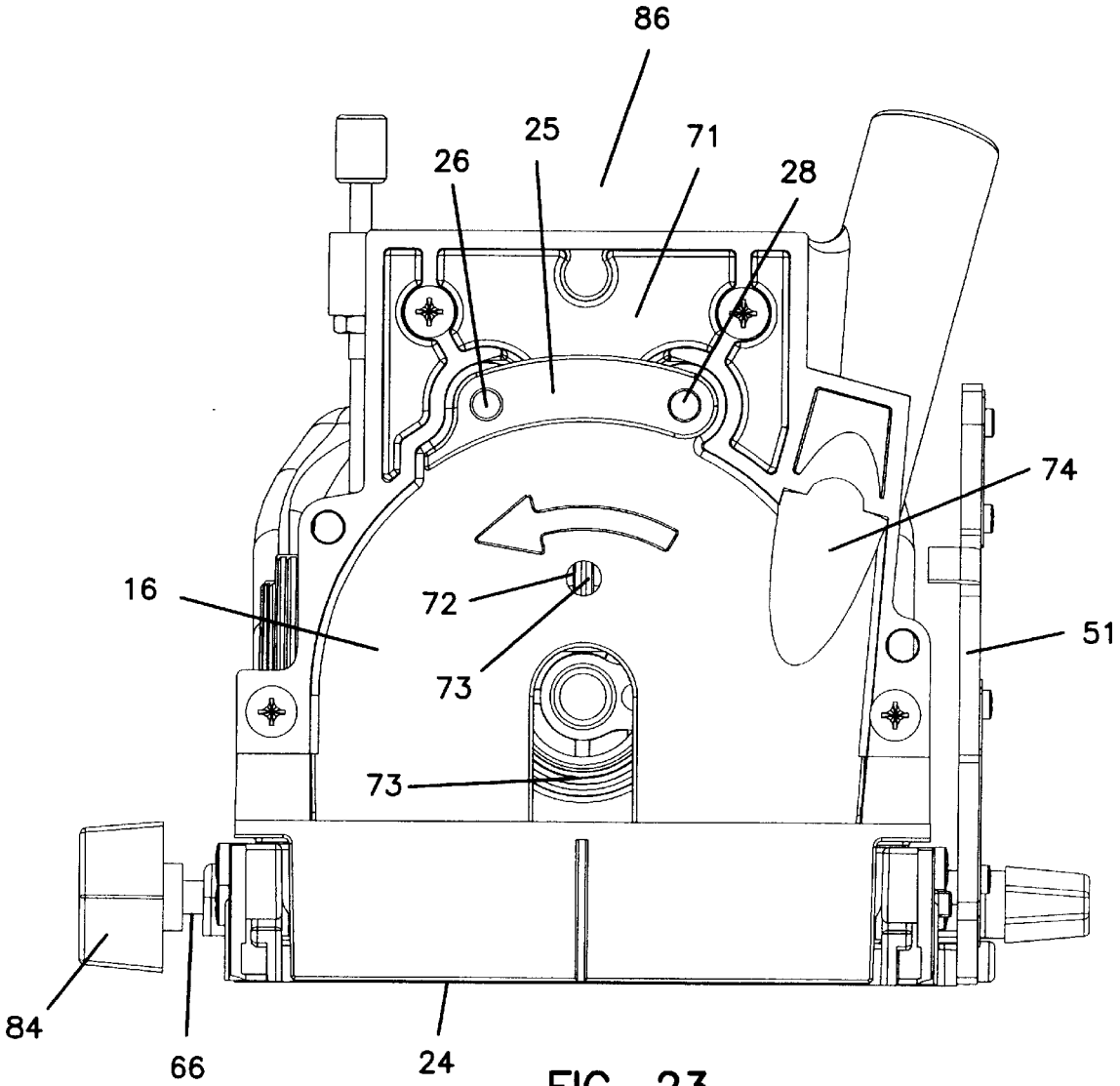
FIG. 23 shows a bottom plan view of the fence system of FIG. 10 with the cutter cover base removed and the safety lever in a rearward release position.
Figure 24:
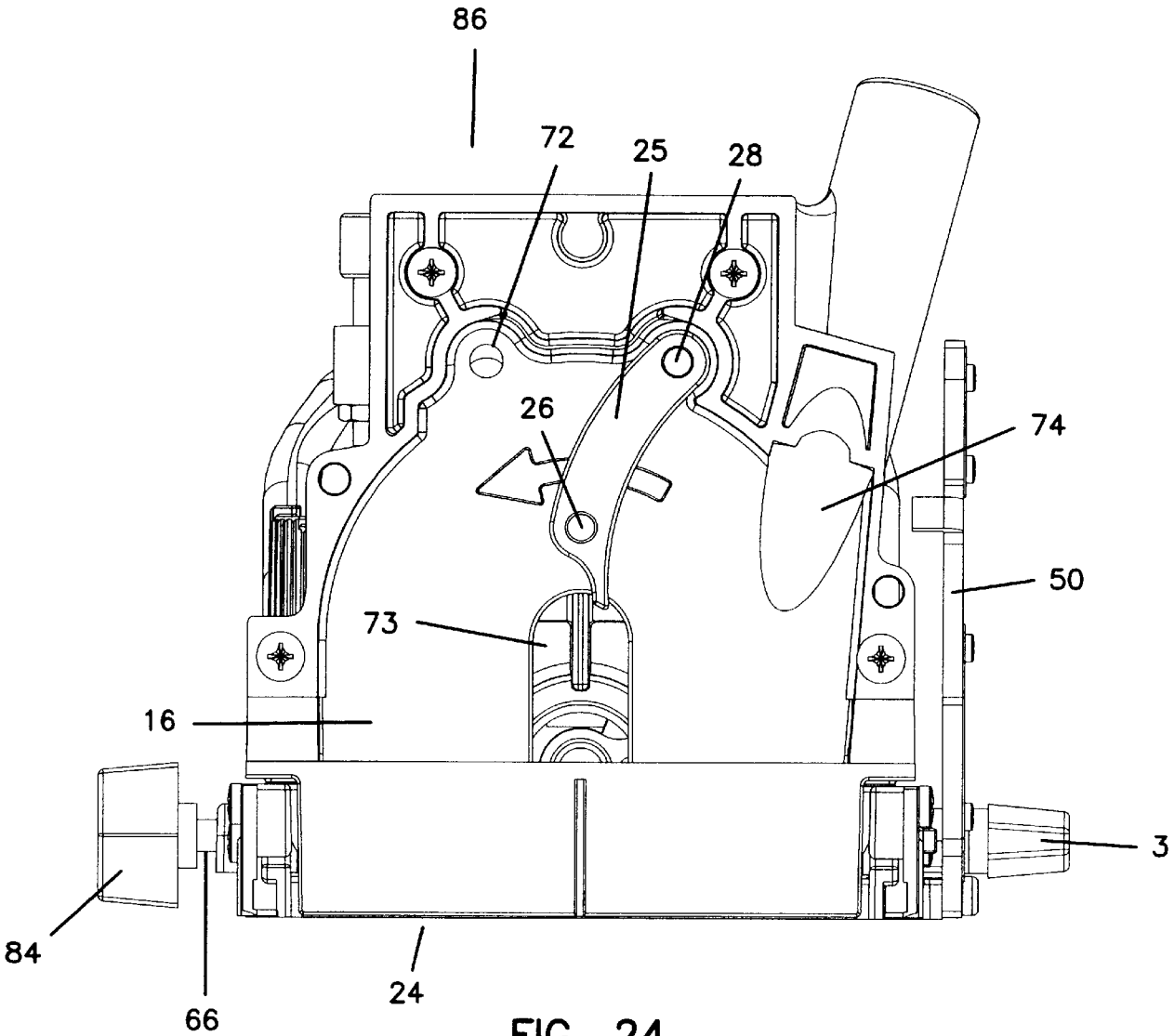
FIG. 24 shows a bottom plan view of the fence system of FIG. 10 with the cutter cover base removed and with the safety lever in a forward release position.
Figure 25A:
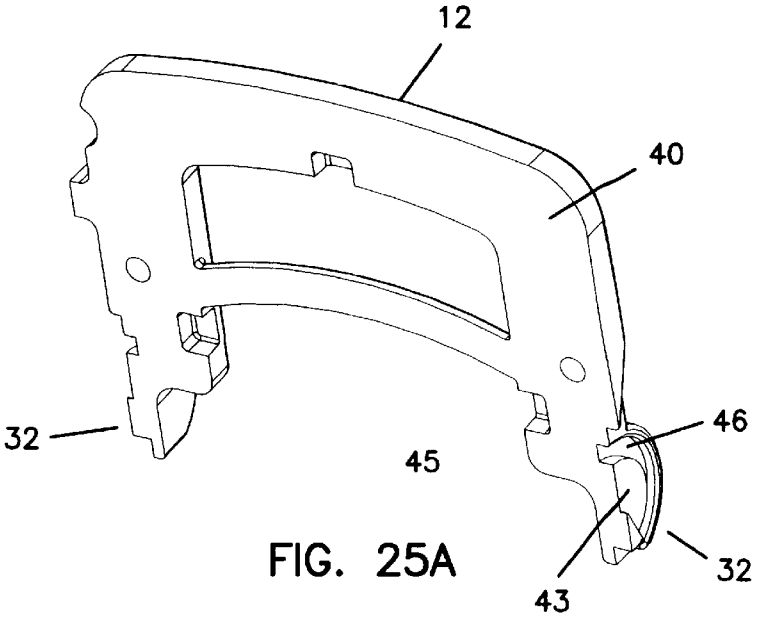
FIGS. 25A and 25B show a top left perspective view and a bottom right perspective view of the front fence, of the fence system of in FIG. 10, illustrating and the groove member of the trunnion.
Figure 25B:
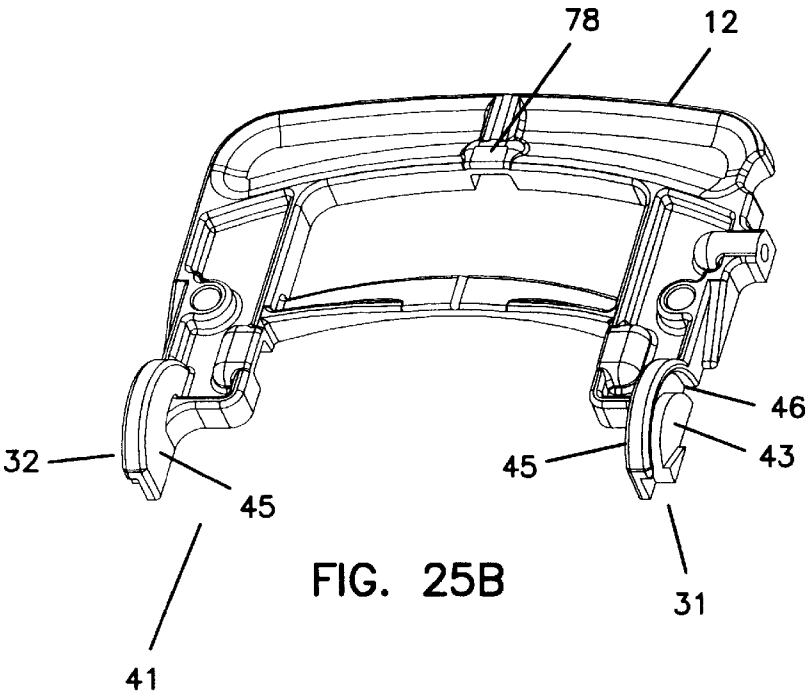
Figure 26A:
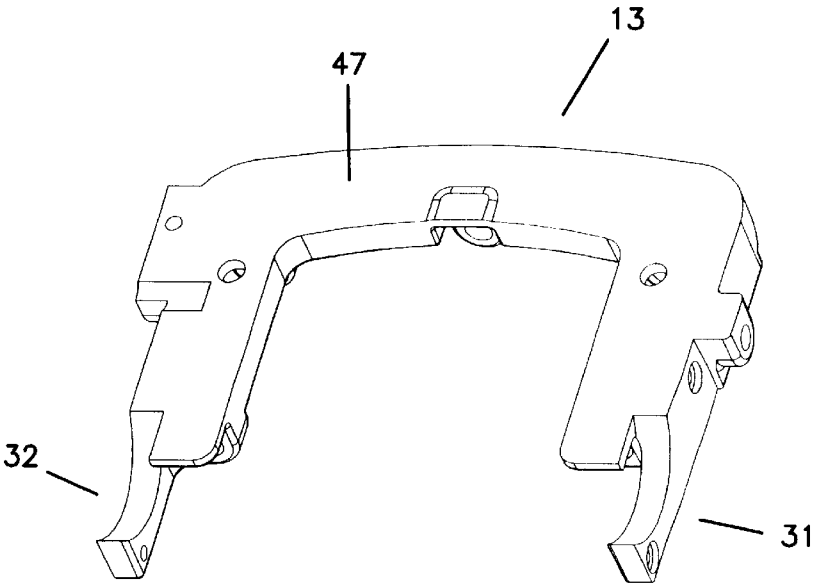
FIGS. 26A and 26B show a bottom left perspective view and a top right perspective view and a top right perspective view, respectively, of the rear fence, of the fence system of in FIG. 10.
Figure 26B:
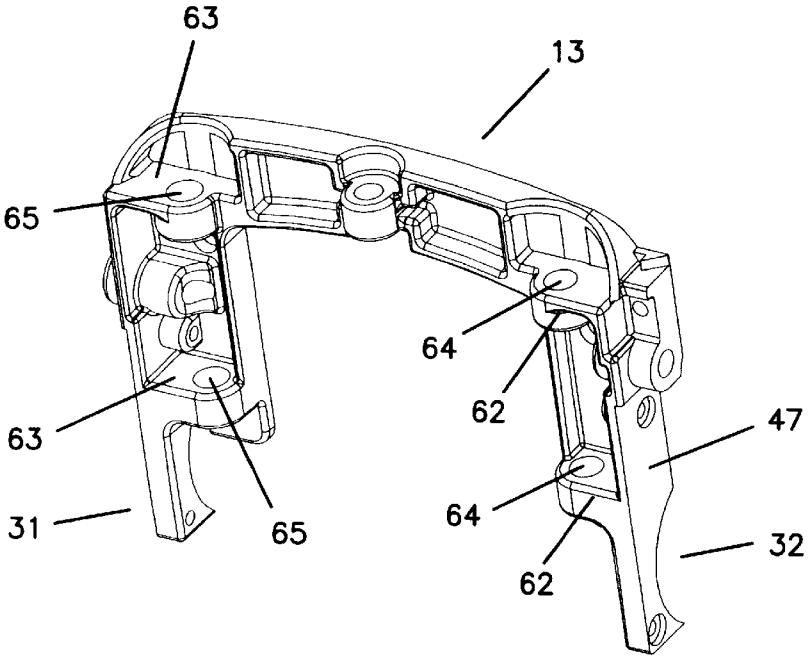
Figure 27A:
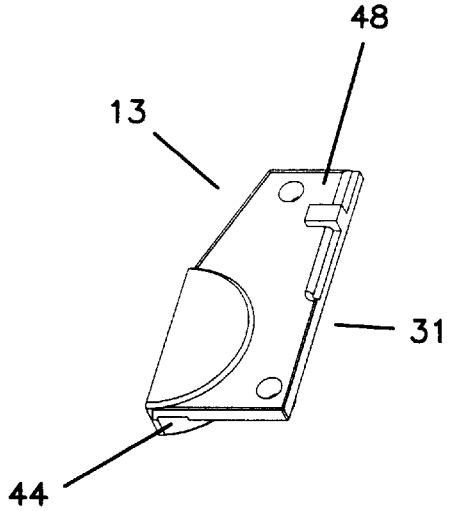
FIGS. 27A–D show perspective views of the trunnion member illustrating the ridge member.
Figure 27B:
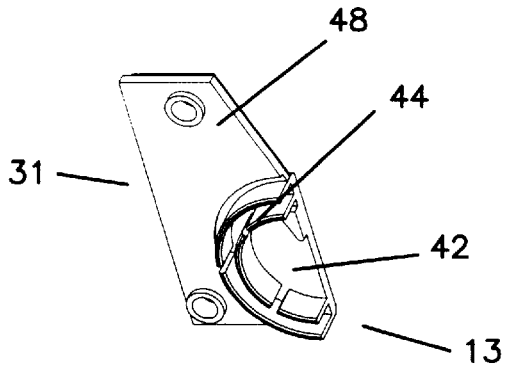
Figure 27D:
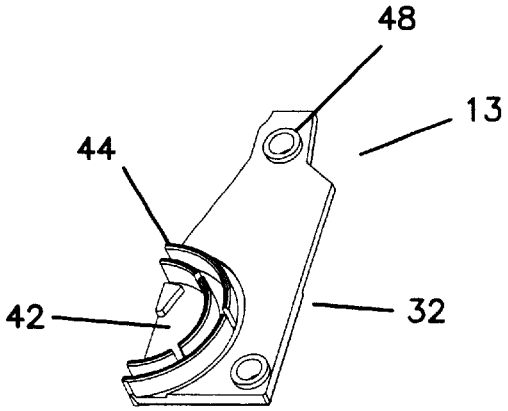
Figure 27C:
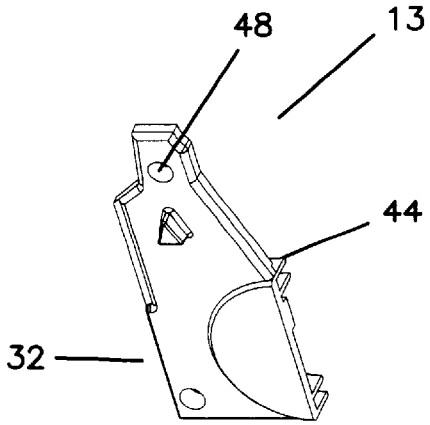
Figure 28B:
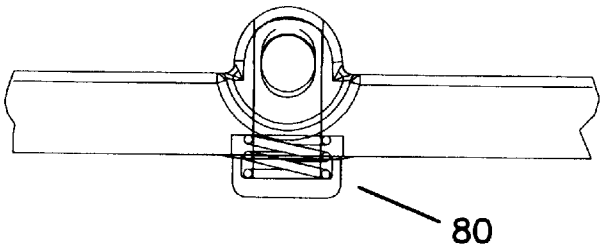
FIG. 28B illustrates a top view of an embodiment of the fence system including a quick release screw.
Figure 28A:
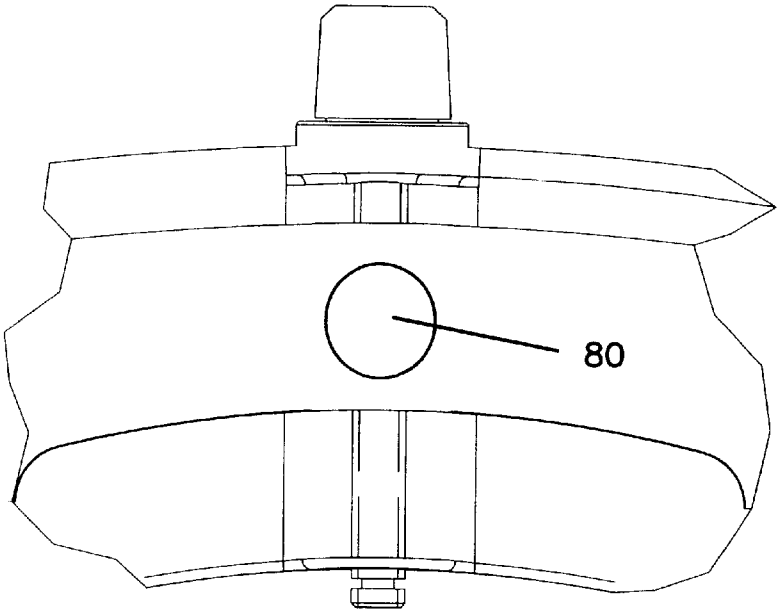
FIG. 28A shows a front view of an embodiment of a fence system including a quick release screw.
Figure 28C:
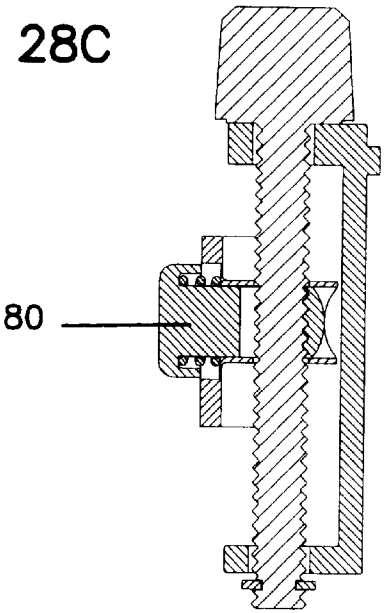
FIG. 28C is a left-side elevational cross-sectional profile taken along cutting line 28—28 of FIG. 28A illustrating the quick release screw.

As shown in FIG. 16 first guide rod 61 is positioned by first guide rod frame 62 and second guide rod 18 is positioned by second guide rod frame 63. Each guide rod frame defines a space around the corresponding guide rod. Preferably, first guide rod frame 62 comprises first through hole 64 in rear fence 13 and second guide rod frame 63 comprises second through hole 65 in rear fence 13. The space between first guide rod 61 and first guide rod frame 62 is advantageously narrower than the space between second guide rod 18 and second guide rod frame 63. Preferably, first through hole 64 has a substantially smaller diameter than second through hole 65, which results in a narrow space between first guide rod 61 and first guide rod frame 62 than between second guide rod 18 and second guide rod frame 63. First guide rod 61 and second guide rod 62 are advantageously of substantially equal diameter. The combination of a tight tolerance for first guide rod 61 and a looser tolerance for second guide rod 18 is one manner in which lateral and tortional movement of rear fence 13 is restrained, while maintaining manufacturing economies.

Height adjustment system 58 includes a height locking system 82 for securing front fence 12 at the desired height and for providing reproducible lateral and torsional positioning and stability of front fence 12 at different heights. Height locking system 82 includes height locking knob 84, threaded pin 66 and plug 19. Height locking system 82 is arranged and configured to bias against a second guide rod 18 and to bias first guide rod 61 against first guide rod frame 62. Individual components of height locking system 82 are configured to bring this about. Turning knob 84 threadably advances threaded pin 66 into rear fence 13 which biases plug 67 against guide rod 18. As this biasing continues rear fence 13 is moved laterally through a distance less than the space surrounding first guide pin 61, and first guide pin 61 is biased against guide rod frame 62. Biasing guide rod 61 against guide rod frame 62 provides reproducible and stable lateral and torsional positioning of rear fence 13, and front fence 12.

The preferred fence system also includes a height gauge 68, which is arranged and configured to provide a reading of fence height relative to any point on the thickness of cutter 113, which corresponds to any point in the thickness of the slot cut by cutter 113. In an especially preferred embodiment, height gauge 68 provides an accurate reading of fence height at any fence angle.

Height gauge 68 includes a scale 10 and a height indicator 69. As shown in the figures, height scale 10 is arranged on a surface of fence support 14 vertical member 60, and height indicator 69 is on rear fence 13 generally adjacent to vertical member 60. Height indicator 69 includes a visible indicator 70 with a thickness along the height scale 10 substantially equivalent to the thickness of the cutter that indicates fence height using height scale 10. In one preferred embodiment, visible indicator 70 is in the shape of a raised rectangle.

As a consequence of this arrangement, by visualizing measurement along the thickness of the visible indicator 70, height gauge 68 indicates the distance from a face of the workpiece to any point in the thickness of cutter 113. With this arrangement of the height gauge and a preferred embodiment of the angle adjustment system, in which at any selected distance from a top face of the workpiece to the fence, the distance from the top face of the workpiece to the cutter remains constant as the front fence angle is adjusted, the height gauge is accurate each selected front fence angle.

In making a plunge cut with the plate joiner, cutter 113 starts in a release position and, as contact surface 24 is pressed against the workpiece, by pushing on a rearward handle portion of the tool, cutter 113 moves forward to a plunge position while cutting a slot in the workpiece. Preferably, in a release position, cutter 113 is completely within fence support 13, which includes cutter housing cover 16, and cutter housing base 17. If such a plate joiner has only a single release position and can use different sized blades, a smaller blade must travel a greater distance before it contacts the workpiece, which is an inconvenience for the plate joiner operator. Preferred cutter sizes include diameters of about 4 inches and about 2 inches. A more convenient arrangement provides a plurality of release positions to reduce the distance from release position to plunge position for smaller blades.

A preferred embodiment of the plate joiner system includes a cutter plunge system 86 arranged and configured for sliding cutter 113 from one of a plurality of release positions to a plunge position. The release positions are configured to reduce the distance between the release and plunge positions as cutter size is reduced. Preferably the distance from the forward edge of the blade in the release position to the contact surface is approximately constant for different sized blades in different release positions. Cutter plunge system 86 includes safety lever system 71, which is arranged and configured to position the cutter at one or more release positions. Safety lever system 71 includes pivot pin 28, which can be a rivet, safety lever 25, and guide pin 26. Safety lever 25 pivots on pivot pin 28 and guide pin 26 engages an aperture 72 in blade housing cover 16 and stoppably engages lower gear housing 73 to retain the cutter in the release position.

The plurality of release positions configures the plate joiner system to advantageously house cutters of two more different sizes. For example, a four inch cutter is advantageous for general use, and a smaller, two inch, cutter is advantageous for applications such as joining face frames. The preferred plate joiner system can house either a two inch blade or a four inch blade, and the cutter plunge system 86 provides for reduced travel of the two inch cutter.

In the release position providing reduced travel for a smaller blade, safety lever 25 prevents installing a larger blade, preferably by physically blocking installation of the larger blade. In such a manner, a safety lever prevents installing a large blade in a release position in which it would protrude from the cutter slot in the release position. The larger blade is accommodated at a more rearward release position.

In a forward position, safety lever 25 is configured to direct cutting dust toward dust aperture 74. The slightly arcuate shape of safety lever 25 provides smooth circulation of air and dust when safety lever 25 is in a rearward release position, and aids in directing dust towards aperture 74 when safety lever 25 is in a forward release position.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A plate joiner, comprising:

a. a fence support comprising a contact surface, a front wall member, a cutter slot defined by the front wall member, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter; and c. a fence system comprising a front fence, a rear fence, and a trunnion; the front fence and rear fence being pivotally coupled by the trunnion, the trunnion comprising a ridge member and a groove member, the ridge member pivotally engaging the groove member.

2. The plate joiner of claim 1, wherein the trunnion comprises an arcuate ridge member and a groove member defining an arcuate groove, the ridge member pivotally engaging the groove member; the front fence comprising the ridge member and the rear fence comprising the groove member, or the front fence comprising the groove member and the rear fence comprising the ridge member.

3. The plate joiner of claim 2, wherein the front fence comprises the groove member and the rear fence comprises the ridge member.

4. The plate joiner of claim 2, wherein the rear fence comprises a rear fence member and a trunnion member, the trunnion member being coupled to the rear fence member and comprising the groove member or the ridge member.

5. The plate joiner of claim 1, wherein the front fence and rear fence are pivotally coupled by two trunnions.

6. The plate joiner of claim 1, wherein the trunnion provides a pivot axis, and the pivot axis lies in a plane distinct from a plane defined by the contact surface.

7. The plate joiner of claim 6, wherein the pivot axis lies forward of a plane defined by the contact surface.

8. The plate joiner of claim 6, wherein the pivot axis lies rearward of a plane defined by the contact surface.

9. The plate joiner of claim 1, wherein the pivot axis is substantially in a plane defined by the contact surface.

10. The plate joiner of claim 1, wherein the front fence comprises a generally planar surface, and the generally planar surface of the front fence defines a plane substantially in a plane defined by the contact surface.

11. The plate joiner of claim 1, wherein the front fence comprises a generally planar surface and the trunnion provides a pivot axis, the pivot axis lying substantially in a plane defined by the generally planar surface of the front fence.

12. The plate joiner of claim 1, wherein the front fence comprises a generally planar surface and the trunnion provides a pivot axis, the pivot axis lying in a plane distinct from the plane defined by the generally planar surface of the front fence.

13. The plate joiner of claim 12, wherein the pivot axis is forward of a plane defined by the generally planar surface of the front fence.

14. The plate joiner of claim 12, wherein the pivot axis is rearward of a plane defined by the generally planar surface of the front fence.

15. The plate joiner of claim 1, wherein at any selected distance from a top face of the workpiece to the cutter, the distance from the top face of the workpiece to the cutter remains substantially constant as the front fence angle is adjusted.

16. The plate joiner of claim 1, further comprising an angle adjustment system, which is constructed to position the front fence at a selected angle in a range of up to about 135 degrees.

17. The plate joiner of claim 16, wherein the angle adjustment system is constructed to position the front fence in a first range of angles comprising about 0° to about 90° and a second range of angles comprising about 90° to about 135°.

18. The plate joiner of claim 16, wherein the angle adjustment system comprises a positive stop at one or more front fence angles.

19. The plate joiner of claim 18, wherein the angle adjustment system comprises a positive stop at a front fence angle of about 0°, about 90°, about 135°, or a combination thereof.

20. The plate joiner of claim 16, wherein the angle adjustment system comprises an angle segment member, the angle segment member defining a first slot and a second slot.

21. The plate joiner of claim 20, wherein the angle segment member is pivotally coupled to the front fence and slidably engages the rear fence.

22. A plate joiner, comprising:

a. a fence support comprising a contact surface, a front wall member, a cutter slot defined by the front wall member, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter; and c. a fence system comprising a front fence, an angle adjustment system, and a pivot axis defined by the front fence and the angle adjustment system; the pivot axis being substantially in a plane defined by the contact surface; the angle adjustment system being constructed to adjust a front fence angle;

d. wherein, at any selected distance from a top face of the workpiece to the fence, the distance from the top face of the workpiece to the cutter remains substantially constant as the front fence angle is adjusted.

23. The plate joiner of claim 22, wherein the fence system further comprises a trunnion and a rear fence, the front fence and rear fence being pivotally coupled by the trunnion.

24. The plate joiner of claim 23, wherein the trunnion comprises a ridge member and a groove member, the ridge member pivotally engaging the groove member.

25. The plate joiner of claim 24, wherein the trunnion comprises an arcuate ridge member and a groove member defining an arcuate groove, the ridge member pivotally engaging the groove member; the front fence comprising the ridge member and the rear fence comprising the groove member, or the front fence comprising the groove member and the rear fence comprising the ridge member.

26. The plate joiner of claim 25, wherein the front fence comprises the groove member and the rear fence comprises the ridge member.

27. The plate joiner of claim 25, wherein the rear fence comprises a rear fence member and a trunnion member, the trunnion member being coupled to the rear fence member and comprising the groove member or the ridge member.

28. The plate joiner of claim 23, wherein the front fence and rear fence are pivotally coupled by two trunnions.

29. The plate joiner of claim 22, wherein the angle adjustment system is constructed to position the front fence at a selected angle in a range of up to about 135 degrees.

30. The plate joiner of claim 29, wherein the angle adjustment system is constructed to position the front fence in a first range of angles comprising about 0° to about 90° and a second range of angles comprising about 90° to about 135°.

31. The plate joiner of claim 29, wherein the angle adjustment system comprises a positive stop at one or more front fence angles.

32. The plate joiner of claim 31, wherein the angle adjustment system comprises a positive stop at a front fence angle of about 0°, about 90°, or about 135°, or a combination thereof.

33. The plate joiner of claim 29, wherein the angle adjustment system comprises an angle segment member, the angle segment member defining a first slot and a second slot.

34. The plate joiner of claim 33, wherein the angle segment member is pivotally coupled to the front fence and slidably engages the rear fence.

35. The plate joiner of claim 22, wherein:

a. the fence system further comprises a height adjustment system and a height gauge; and b. the height gauge comprises a scale and a height indicator; the scale comprising indicia indicating a measurement of front fence height; the height indicator comprising a visible indicator with a thickness along the scale substantially equivalent to the thickness of the cutter; the height indicator indicating a front fence height on the height scale;

c. whereby by visualizing the measurement along the thickness of the visible indicator, the height gauge indicates the distance from a face of the workpiece to any point in the thickness of the cutter.

36. The plate joiner of claim 35, wherein the fence support further comprises a vertical member, and the height adjustment system further comprises the vertical member and a rear fence; the height scale is adjacent to the rear fence; and the rear fence comprises the visible indicator.

37. The plate joiner of claim 35, wherein the visible indicator comprises a raised rectangle.

38. The plate joiner of claim 35, wherein the height gauge is accurate at each selected front fence angle.

39. A plate joiner, comprising:

a. a fence support comprising a contact surface, a front wall member, a cutter slot defined by the front wall member, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter; and c. a fence system comprising a front fence, an angle adjustment system, and a pivot axis defined by the front fence and the angle adjustment system; the pivot axis being substantially in a plane defined by the contact surface.

40. The plate joiner of claim 39, wherein the angle adjustment system is constructed for adjusting a front fence angle, and at any selected distance from a top face of the workpiece to the cutter, the distance from the top face of the workpiece to the cutter remains substantially constant as the front fence angle is adjusted.

41. The plate joiner of claim 39, wherein the fence system further comprises a trunnion and a rear fence; the front fence and rear fence being pivotally coupled by the trunnion.

42. The plate joiner of claim 41, wherein the trunnion comprises a ridge member and a groove member, the ridge member pivotally engaging the groove member.

43. The plate joiner of claim 42, wherein the trunnion comprises an arcuate ridge member and a groove member defining an arcuate groove, the ridge member pivotally engaging the groove member; the front fence comprising the ridge member and the rear fence comprising the groove member, or the front fence comprising the groove member and the rear fence comprising the ridge member.

44. The plate joiner of claim 43, wherein the front fence comprises the groove member and the rear fence comprises the ridge member.

45. The plate joiner of claim 43, wherein the rear fence comprises a rear fence member and a trunnion member, the trunnion member being coupled to the rear fence member and comprising the groove member or the ridge member.

46. The plate joiner of claim 41, wherein the front fence and rear fence are pivotally coupled by two trunnions.

47. The plate joiner of claim 39, wherein the angle adjustment system is constructed to position the front fence at a selected angle in a range of up to about 135°.

48. The plate joiner of 47, wherein the angle adjustment system is constructed to position the front fence in a first range of angles comprising about 0° to about 90° and a second range of angles comprising about 90° to about 135°.

49. The plate joiner of 47, wherein the angle adjustment system comprises a positive stop at one or more front fence angles.

50. The plate joiner of 49, wherein the angle adjustment comprises a positive stop at a front fence angle of about 0°, about 90°, about 135°, or a combination thereof.

51. The plate joiner of 47, wherein the angle adjustment system comprises an angle segment member, the angle segment member defining a first slot and a second slot.

52. The plate joiner of claim 51, wherein the angle segment member is pivotally coupled to the front fence and slidably engages the rear fence.

53. A plate joiner, comprising:

a. a fence support comprising a contact surface, a front wall member, a cutter slot defined by the front wall member, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter;

c. a cutter plunge system, the cutter plunge system being constructed to slide the cutter from a release position to a plunge position and providing a plurality of release positions; and d. a fence system comprising a front fence, a height adjustment system, and an angle adjustment system; the height adjustment system being constructed to restrain lateral and a torsional movement of the front fence; and the angle adjustment system being constructed to adjust a front fence angle;

e. wherein, at any selected distance from a top face of the workpiece to the cutter, the distance from the top face of the workpiece to the cutter remains substantially constant as the front fence angle is adjusted.

54. The plate joiner of claim 53, wherein:

a. the cutter plunge system comprises a cutter housing cover, a lower gear housing and a safety lever system; the cutter housing cover slidably engaging the lower gear housing; and b. the safety lever system comprises a pivot pin, a guide pin, and a safety lever; the pivot pin being coupled to the cutter housing cover and providing a pivot for pivoting the safety lever between release positions; the safety lever being coupled to the guide pin; the guide pin stoppably engaging the lower gear housing at a release position.

55. The plate joiner of claim 53, wherein the fence support is dimensioned to alternately house cutters of two or more different sizes and the cutter plunge system comprises two or more release positions.

56. The plate joiner of claim 55, wherein in a first release position the fence support is dimensioned to house a cutter with a diameter of about four inches, and in a second release position the fence support is dimensioned to house a cutter with a diameter of about two inches.

57. The plate joiner of claim 56, wherein the cutter plunge system comprises a safety lever system; the safety lever system being constructed to position the cutter at one or more release positions; in the second release position the safety lever excluding the cutter with a diameter of about four inches.

58. The plate joiner of claim 53, wherein at any release position, the cutter is completely within the fence support.

59. The plate joiner of claim 53, wherein the fence support further comprises an aperture for expelling the cutting dust;

and the cutter plunge system comprises a safety lever system shaped and oriented for directing the cutting dust toward the aperture in at least one release position.

60. The plate joiner of claim 53, wherein a. the fence support further comprises a vertical member, and the height adjustment system further comprises a threaded rod, a first guide rod, a first guide rod frame, a second guide rod, a second guide rod frame, the vertical member, and a rear fence; each guide rod frame defining a space around the corresponding guide rod; the space between the first guide rod and the first guide rod frame being substantially narrower than the space between the second guide rod and the second guide rod frame;

b. the vertical member and the rear fence each being substantially perpendicular to the cutter; the threaded rod threadably engaging the rear fence and being rotatably retained by the vertical member; the vertical member comprising the guide rods and the rear fence comprising the guide rod frames.

61. The plate joiner of claim 60, wherein:

a. the first guide rod frame comprises a first through hole in the rear fence and the second guide rod frame comprises a second a through hole in the rear fence;

b. the guide rods are of substantially equal diameter and the first through hole diameter is substantially less than the second through hole diameter.

62. The plate joiner of claim 61, wherein the height adjustment system further comprises a height locking system for retaining the front fence at a desired height; the height locking system comprising a threaded pin threadably engaging the rear fence and constructed to bias against a guide rod and to bias a guide rod against a guide rod frame.

63. The plate joiner of claim 53, wherein the fence system further comprises a height gauge comprising a scale and a height indicator; the scale comprising indicia indicating a measurement of front fence height; the height indicator comprising a visible indicator with a thickness along the scale substantially equivalent to the thickness of the cutter; the height indicator indicating a front fence height on the height scale.

64. The plate joiner of claim 63, wherein the fence support further comprises a vertical member, and the height adjustment system further comprises the vertical member and a rear fence; the height scale is adjacent to the rear fence; and the rear fence comprises the visible indicator.

65. The plate joiner of claim 64, wherein the visible indicator has a thickness along the scale substantially equivalent to the thickness of the cutter.

66. The plate joiner of claim 65, wherein the visible indicator comprises a raised rectangle.

67. The plate joiner of claim 65, wherein the fence system defines a pivot axis substantially in a plane defined by the contact surface.

68. The plate joiner of claim 67, wherein the height gauge is accurate at each selected front fence angle.

69. The plate joiner of claim 53, wherein the fence system defines a pivot axis substantially in a plane defined by the contact surface.

70. The plate joiner of claim 53, wherein the fence system further comprises a trunnion and a rear fence, which is substantially perpendicular to the cutter; the front fence and rear fence being pivotally coupled by the trunnion.

71. The plate joiner of claim 70, wherein the trunnion comprises a ridge member and a groove member, the ridge member pivotally engaging the groove member.

72. The plate joiner of claim 71, wherein the trunnion comprises an arcuate ridge member and a groove member defining an arcuate groove, the ridge member pivotally engaging the groove member; the front fence comprising the ridge member and the rear fence comprising the groove member.

73. The plate joiner of claim 72, wherein the rear fence comprises a rear fence member and a trunnion member, the trunnion member being coupled to the rear fence member and comprising the groove member.

74. The plate joiner of claim 71, wherein the front fence and rear fence are pivotally coupled by two trunnions.

75. The plate joiner of claim 71, wherein the angle adjustment system is constructed to position the front fence at a selected angle in a range of up to about 135 degrees.

76. The plate joiner of claim 75, wherein the angle adjustment system is constructed to position the front fence in a first range of angles comprising about 0° to about 90° and a second range of angles comprising about 90° to about 135°.

77. The plate joiner of claim 75, wherein the angle adjustment system comprises a positive stop at one or more front fence angles.

78. The plate joiner of claim 77, wherein the angle adjustment system comprises a positive stop at a front fence angle of about 0°, about 90°, about 135°, or a combination thereof.

79. The plate joiner of claim 75, wherein the angle adjustment system comprises an angle segment member, the angle segment member defining a first slot and a second slot.

80. The plate joiner of claim 79, wherein the angle segment member is pivotally coupled to the front fence and slidably engages the rear fence.

81. A plate joiner, comprising:

a. a fence support comprising a contact surface, a cutter slot defined by the contact surface, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter; and c. a fence system comprising a front fence, and a height adjustment system; the height adjustment system comprising a first guide rod, a first guide rod frame, a second guide rod, and a second guide rod frame; the guide rods and guide rod frames being constructed for restraining lateral and torsional movement of the front fence;

d. the front fence comprising a generally planar surface, the generally planar surface of the front fence defining a plane substantially in a plane defined by the contact surface.

82. A plate joiner, comprising:

a. a fence support comprising a contact surface, a front wall member, a cutter slot defined by the front wall member, and a cutter; the cutter protruding from the fence support through the cutter slot and making a plunge cut into a surface of a workpiece when the contact surface of the fence support is pressed against the surface and the cutter is plunged into the workpiece;

b. a drive for rotatably driving the cutter; and c. a fence system comprising a front fence, and a height adjustment system; the height adjustment system comprising a first guide rod, a first guide rod frame, a second guide rod, and a second guide rod frame; the guide rods and guide rod frames being constructed for restraining lateral and torsional movement of the front fence;

d. the front fence comprising a generally planar surface, the generally planar surface of the front fence defining a plane substantially in a plane defined by the contact surface.

* * * * *